US007021890B2

(12) United States Patent
Ishigaki et al.

(10) Patent No.: US 7,021,890 B2
(45) Date of Patent: Apr. 4, 2006

(54) TURBO PUMP

(75) Inventors: Eiichi Ishigaki, Sakaide (JP); Tomoki Yoshida, Kagawa (JP)

(73) Assignee: Ishigaki Company Limited, Tokyo (JP)

( * ) Notice: Subject to any disclaimer, the term of this patent is extended or adjusted under 35 U.S.C. 154(b) by 0 days.

(21) Appl. No.: 10/250,677

(22) PCT Filed: Oct. 30, 2002

(86) PCT No.: PCT/JP02/11307

§ 371 (c)(1),
(2), (4) Date: Jul. 16, 2003

(87) PCT Pub. No.: WO03/038284

PCT Pub. Date: May 8, 2003

(65) Prior Publication Data

US 2004/0067133 A1 Apr. 8, 2004

(30) Foreign Application Priority Data

Nov. 1, 2001 (JP) ..... 2001-336213
May 14, 2002 (JP) ..... 2002-138253

(51) Int. Cl.
*F04D 29/30* (2006.01)

(52) U.S. Cl. ..... 415/72; 416/223 R

(58) Field of Classification Search ..... 415/71–74, 415/211.2, 212.1; 416/176, 188, 223 R
See application file for complete search history.

(56) References Cited

U.S. PATENT DOCUMENTS 2,483,335 A * 9/1949 Davis ..... 415/210.1
3,243,102 A * 3/1966 McMahan ..... 415/208.2
4,063,849 A * 12/1977 Modianos ..... 415/210.1
4,427,336 A * 1/1984 Lake ..... 415/71

FOREIGN PATENT DOCUMENTS

| | | |
|---|---|---|
| GB | 1308541 | 2/1973 |
| JP | 342095 | 4/1991 |
| JP | 5321867 | 12/1993 |
| JP | 791395 | 4/1995 |
| JP | 7247984 | 9/1995 |
| JP | 10184589 | 7/1998 |
| JP | 1130194 | 2/1999 |
| JP | 2001271779 | 10/2001 |

OTHER PUBLICATIONS

English Language Abstract of JP Appln. No. 5-321867.
English Language Abstract of JP Appln. No. 2001-271779.

(Continued)

*Primary Examiner*—Ninh H. Nguyen
(74) *Attorney, Agent, or Firm*—Greenblum & Bernstein, P.L.C.

(57) ABSTRACT

In order to provide a high-head, large-delivery turbopump adapted for excellent suction performance and foreign matter passability by having characteristics of an inducer, axial flow vanes, and mixed flow vanes imparted together to centrifugal vanes, a progressively diameter-increased suction casing rear part has arranged therein an impeller configured with two to four rotary vanes wound around a hub, to define rotary channels having a vane outlet channel width of 26% in proportion to a vane inlet outer circumference diameter, the rotary vanes being each respectively configured as a collision-less connection of an upstream axial-flow screw part provided with an inducer part extending into a suction fluid path of a suction casing front part at a vane inlet angle of 14°, an intermediate mixed-flow screw part, and a downstream centrifugal screw part.

15 Claims, 18 Drawing Sheets

OTHER PUBLICATIONS

Partial English Language Translation of JP Appln. No. 3-42095.
English Language Abstract of JP Appln. No. 7-247984.
English Language Abstract of JP Appln. No. 10-184589.
English Language Abstract of JP Appln. No. 7-91395.
English Language Abstract of JP Appln. No. 11-30194.

* cited by examiner

RELATIONSHIP BETWEEN NS AND M-CONTOURS

| TYPES | CENTRIFUGAL | MIXED FLOW | | AXIAL FLOW |
|---|---|---|---|---|
| Ns | 100～150 | 350～550 | 600～1100 | 1200～2000 |
| M-CONTOURS |  |  |  |  |

TURBO PUMP

TECHNICAL FIELD

The present invention relates to a turbo-type pump (hereafter called "turbopump"), and in particular, to a turbopump capable of large delivery in high head conditions.

BACKGROUND ART

As a liquid transfer machine, a pump is classifiable from the point of view of working principles into a turbopump, a positive displacement pump, and a special pump.

The turbopump has a casing and a vaned rotor (called "impeller") disposed therein cooperatively defining channels for liquid to flow, and is adapted for the impeller's rotation to provide liquid in the channels with a pumping head. The head-provided liquid is called "pumped liquid".

For conventional turbopumps, fundamental impeller types and typical characteristics are listed in Table-1 below.

TABLE 1

Fundamental Impeller Types and Typical Characteristics

| Types | Centrifugal | Mixed flow | Axial flow |
|---|---|---|---|
| Outflow direction | Radial | Diagonal | Axial |
| Head provider | CF*[1] | CF*[1] + VPF*[2] | VPF*[2] |
| Head, H | High | Moderate | Low |
| Delivery, Q | Small | Moderate | Large |
| Specific speed, Ns | 100~150 | 350~1100 | 1200~2000 |
| Meridian contour | C1, C2 (FIG. 26) | C3~C6 (FIG. 26) | C7 (FIG. 26) |

*[1]CF = centrifugal force, *[2]VPF = vane's pumping force

As shown in the Table-1, the impeller of turbopump is classifiable into three fundamental types according to the outflow direction of pumped liquid. In other words, a centrifugal type has an outflow direction substantially perpendicular to the axis of rotation, which is radial; a mixed flow type has an outflow direction diagonal to the axis of rotation; and an axial flow type has an outflow direction substantially parallel to the axis of rotation. In the axial flow type, liquid flows in an axial direction, receiving axial pumping forces from the vanes of the impeller, and obtaining a head principally therefrom. In the mixed flow type, flowing liquid has radial moving components and receives commensurate centrifugal forces, as well as pumping forces from vanes, thereby obtaining head. In the centrifugal type, liquid flows in radial directions, receiving centrifugal forces, and obtaining head principally therefrom. Accordingly, in general, the centrifugal type has high head, but small delivery. However, the axial flow type has low head, but large delivery. The mixed flow type falls somewhere in between.

In this respect, the outflow direction of pumped liquid depends change in the radial direction of channels. Radial changes in channels are easily understood by observing a meridian map of the channels, that is, a meridian channel (hereafter referred to as "M-channel").

The Meridian map is a rotational mapping of a body of rotation onto a meridian plane (i.e., a plane that includes the axis of rotation). In the case of turbopump, it appears as a meridian contour (hereafter sometimes referred to as "M-contour"), where the impeller and a casing that constitutes a shroud of one or more channels have their inside contours (which actually extend in a circumferential direction with their curvilinear changes) circumferentially projected on a plane including an axis of the impeller, there being manifested an angular change.

The M-contour can be generally specified by a non-dimensional parameter called "specific speed". The specific speed corresponds to a required number of revolutions (rpm) of the pump for delivery of a unit flow rate (1 $m^3$/min) of liquid pumped to a unit head (1 m). Letting Q be a delivery flow ($m^3$/min) at a designed number of revolutions N (rpm) of a target pump, and H be a total head (m), the specific speed Ns of the pump can be expressed such that:

$$Ns=N\cdot Q^{1/2}/H^{3/4}.$$

For conventional turbopumps, FIG. 26 shows a relationship between the specific speed Ns and exemplary M-contours MC1~MC7. As will be apparent from FIG. 26, for the centrifugal type (MC1, MC2) to be large in H and small in Q, the Ns can be as small as ranging approx. 100 to approx. 150, however for the axial flow type (MC7) to be small in H and large in Q, the Ns can be as large as ranging approx. 1200 to approx. 2000. For the mixed flow type (MC3~MC6), the Ns can decrease from approx. 550 to approx. 350, as the outflow direction of pumped liquid approaches (MC3←MC4) a radial direction, or on the contrary, can increase from approx. 600 to approx. 1100, as the outflow direction of pumped liquid approaches (MC5→MC6) an axial direction. M-contours, e.g. MC1 and MC2, of impellers of the centrifugal type define M-channels, e.g. mp1 and mp2, extending in a radial direction at their delivery ends. M-contours, e.g. MC3~MC6, of impellers of the mixed flow type define M-channels, e.g. mp3~mp6, diagonal to the axis of rotation at their delivery ends. M-contours, e.g. MC7, of impellers of the axial flow type define M-channels, e.g. mp7, substantially parallel to the axis of rotation at their delivery ends.

The configuration of such conventional turbopumps will be described below. The turbopump will be called "axial flow pump" when provided with an axial flow type of impeller, "mixed flow pump" when provided with a mixed flow type of impeller, or "centrifugal pump" when provided with a centrifugal type of impeller.

Japanese Patent Application Laying-Open Publication No. 7-247984 has disclosed a conventional axial flow pump. This axial flow pump is configured with an axial flow impeller provided in a cylindrical casing, to have large delivery and low head. This impeller has an M-channel widened at the suction end to reduce the net positive suction head.

Japanese Patent Application Laying-Open Publication No. 10-184589 has disclosed a conventional mixed flow pump. This mixed flow pump is configured with a mixed flow impeller provided in a drum-shaped pump casing, so that liquid receives the impeller's pumping forces and centrifugal forces, thereby obtaining head. This impeller has gap narrowing members fixed to vanes thereof for reducing leakage of liquid.

Japanese Patent Application Laying-Open Publication No. 7-91395 has disclosed a conventional centrifugal pump. This centrifugal pump has an impeller configured with an M-channel lying along the axial direction of a spindle at the suction end, moderately curving on the way, and extending in a radial direction at the delivery end. With its centrifugal effect, it is well adapted for pumping water to a high or distant site. The rotation shaft is made short by employing a stationary pressure type bearing in liquid.

Japanese Patent Application Laying-Open Publication No. 11-30194 has disclosed another conventional centrifugal pump. This centrifugal pump is configured with an inducer added at the suction end of a centrifugal impeller, and has good suction performance. By the provision of a balance disc at the delivery end, the impeller has balanced thrust forces acting thereon.

The axial flow pump, having a relatively large specific speed, can have an extremely large delivery flow. It however is unable to raise the head, because cavitation occurs at high heads.

The mixed flow pump, having a medium specific speed, can have a higher head than the axial flow pump. It however is unable to have a large delivery flow due to cavitation.

The centrifugal pump, having a relatively small specific speed (about 100~300), can have a higher head than the mixed flow pump. It however is subject to an ever smaller delivery flow due to cavitation.

The centrifugal impeller may have an increased inlet diameter for the suction performance to be successfully enhanced to provide the centrifugal pump with a to some extent improved anti-cavitation performance, but with a resultant failure to achieve a sufficient delivery flow.

In this respect, at the suction end of the centrifugal impeller, an inducer configured with two to four spiral vanes may be successfully added, to sufficiently enhance the suction performance of centrifugal pump.

It however is necessary for conventional centrifugal pumps to have six or more vanes in order to achieve a sufficient delivery flow, while securing the high head.

As a solution, there has been provided a communication path commonly interconnecting the respective channels of an inducer and respective channels of an impeller, allowing fluid from the inducer to be evenly distributed over the impeller.

As a result, foreign matter in the fluid sometimes got tangled around the communication path.

This invention has been made in view of such points. It therefore is an object of the invention to provide a turbopump adapted for a sufficient delivery flow to be achieved with a high head secured, as well as for the passability of foreign matter to be good.

DISCLOSURE OF INVENTION

To achieve the object described, according to an aspect of the invention, a turbopump comprises a single impeller provided in a single pump casing, the impeller having a total number of I (I>1) rotary vanes each respectively comprising an axial flow vane portion continuously formed with an inducer portion, a mixed flow vane portion collisionlessly connected to the axial flow vane portion, and a centrifugal vane portion collisoinlessly connected to the mixed flow vane portion.

It is noted that, preferably, the inducer portion confronts a straight-tubular part of a suction casing portion of the pump casing.

Preferably, I=2~4.

Preferably, a respective rotary vane has a vane inlet angle of 14°.

Preferably, a respective rotary vane has a vane outlet angle within a range of 10°~11.8°.

As a total number of I rotary channels are defined by the total number of I rotary vanes, a respective rotary channel may preferably have a channel width thereof set at a vane outlet to 26% of a diameter of an outside circumference at a vane inlet of the total number of I rotary vanes.

Preferably, downstream of the impeller, a diffuser with a total number of J (J>6) stationary guide vanes is provided.

Preferably, the pump casing comprises a suction casing portion configured to accommodate the impeller, and a volute delivery casing portion connected to the suction casing portion.

Preferably, the impeller has a horizontal or vertical spindle.

BEST MODE FOR CARRYING OUT THE INVENTION

There will be described below three preferred embodiments of the present invention, with reference to FIG. 1~FIG. 25.

First, description will be made of the configuration of a turbopump according to a first embodiment of the invention, based on FIG. 1~FIG. 6, to relay the contents, before comprehensive description made of dimensions and functions of an essential portion, based on FIG. 7~FIG. 11, with occasional reference to FIG. 12~FIG. 23, for turbopumps according to embodiments of the invention. There will then be a description of a first modification of the first embodiment based on FIG. 12~FIG. 14, a second modification of the first embodiment based on FIG. 15~FIG. 17, a third modification of the first embodiment based on FIG. 18~FIG. 20, and a fourth modification of the first embodiment based on FIG. 21~FIG. 23. Subsequently, description will be made of a second embodiment of the invention based on FIG. 24, and a third embodiment of the invention based on FIG. 25.

(First Embodiment)

Figure 1:
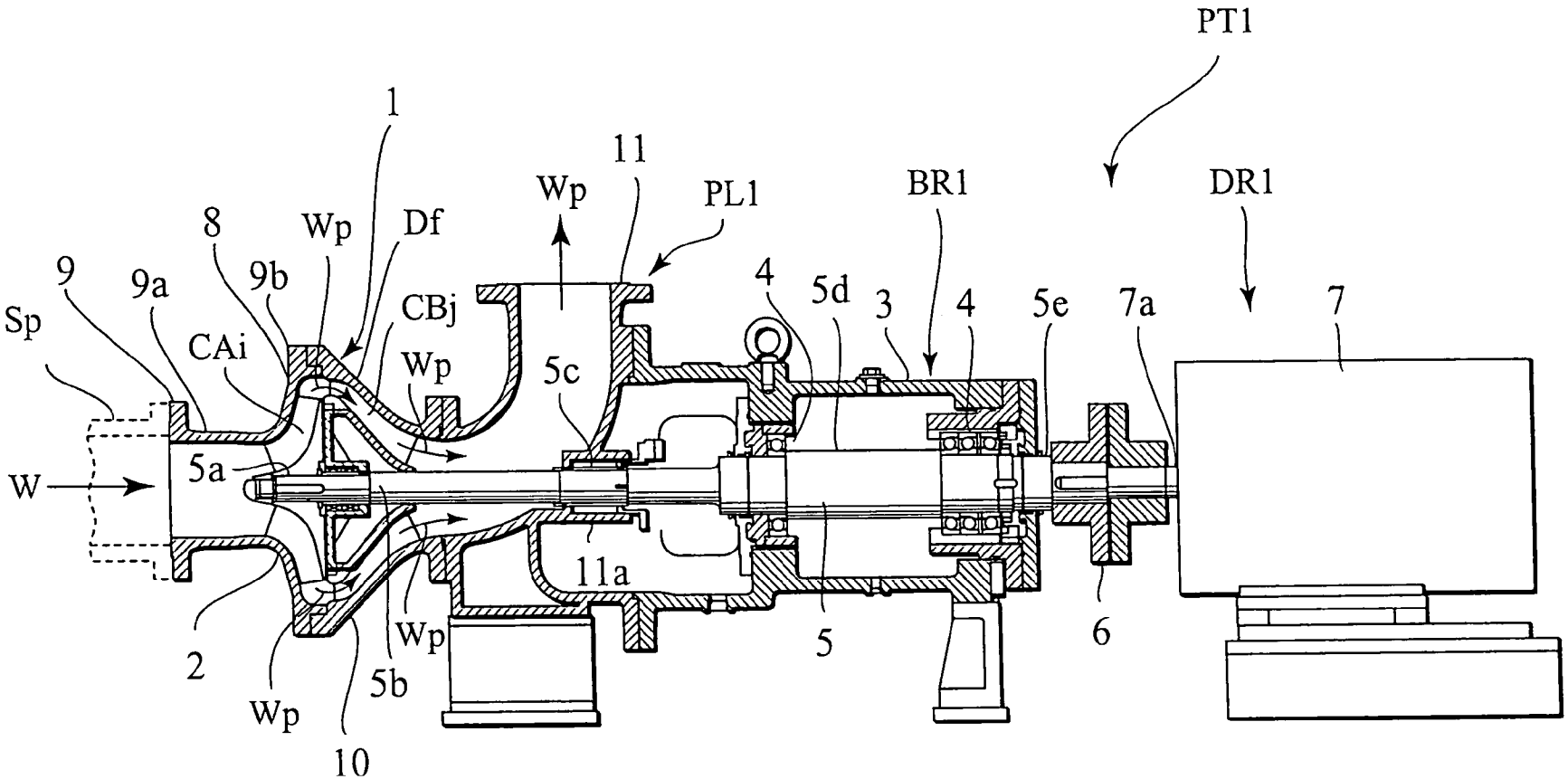
FIG. 1 is a longitudinal sectional view, partially in M-contour, of an essential portion of a plant equipped with a turbopump according to a first embodiment of the invention.

FIG. 1 shows an essential portion PT1 of a plant equipped with a single-staged horizontal shaft type turbopump 1 (hereafter called "horizontal shat pump") according to the first embodiment.

The plant essential portion PT1 is configured as a water pumping installation for pumping rain water W pooled at a low-depth underground, and includes an elbow-shaped water pumping line PL1, a bearing mechanism BR1 provided to the water pumping line PL1 for bearing a spindle 5 of the horizontal shat pump 1 to be horizontal, and a drive mechanism DR1 for driving the spindle 5 to rotate. The bearing mechanism BR1 is configured with a bearing box 3 having left and right bearings 4 and 4 supporting the spindle 5, at a right half 5*d* thereof in the figure, in a both-end supporting manner. The drive mechanism DR1 includes an externally controlled electric motor 7, and a shaft coupling 6 for fastening a right end 5*e* of the spindle 5 to an output shaft 7*a* of the motor 7.

Figure 2:
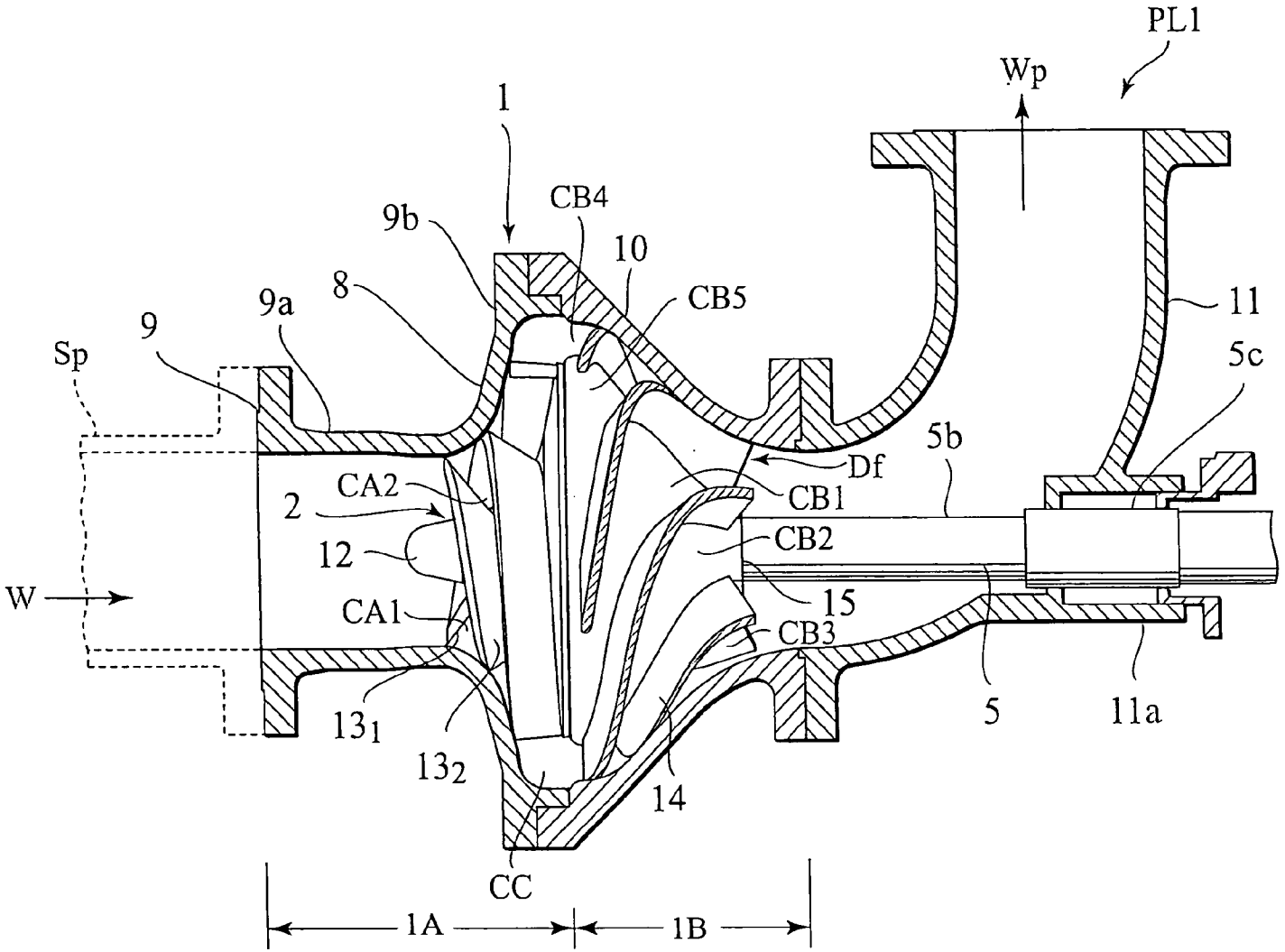
FIG. 2 is a longitudinal sectional view of piping in the plant essential portion of FIG. 1.

FIG. 2 shows a section of the water pumping line PL1.

The water pumping line PL1 is configured with the horizontal shaft pump 1, a water conducting straight pipe Sp flange-connected to a left half 9*a* of a suction casing 9 of the pump 1 in the figure, and a stationary elbow tube 11 flange-connected to a delivery casing 10 of the pump 1. The elbow tube 11 has a water sealed part 11*a* for a longitudinally intermediate part 5*c* of the spindle 5 to be horizontally provided therethrough.

The horizontal shaft pump 1 is constituted as a direct integration of a single suction type water pumping portion 1A configured to give a head to suctioned water W to be changed to pumped liquid Wp, and a water delivery portion 1B configured for guiding pumped liquid Wp to be delivered.

Figure 5:
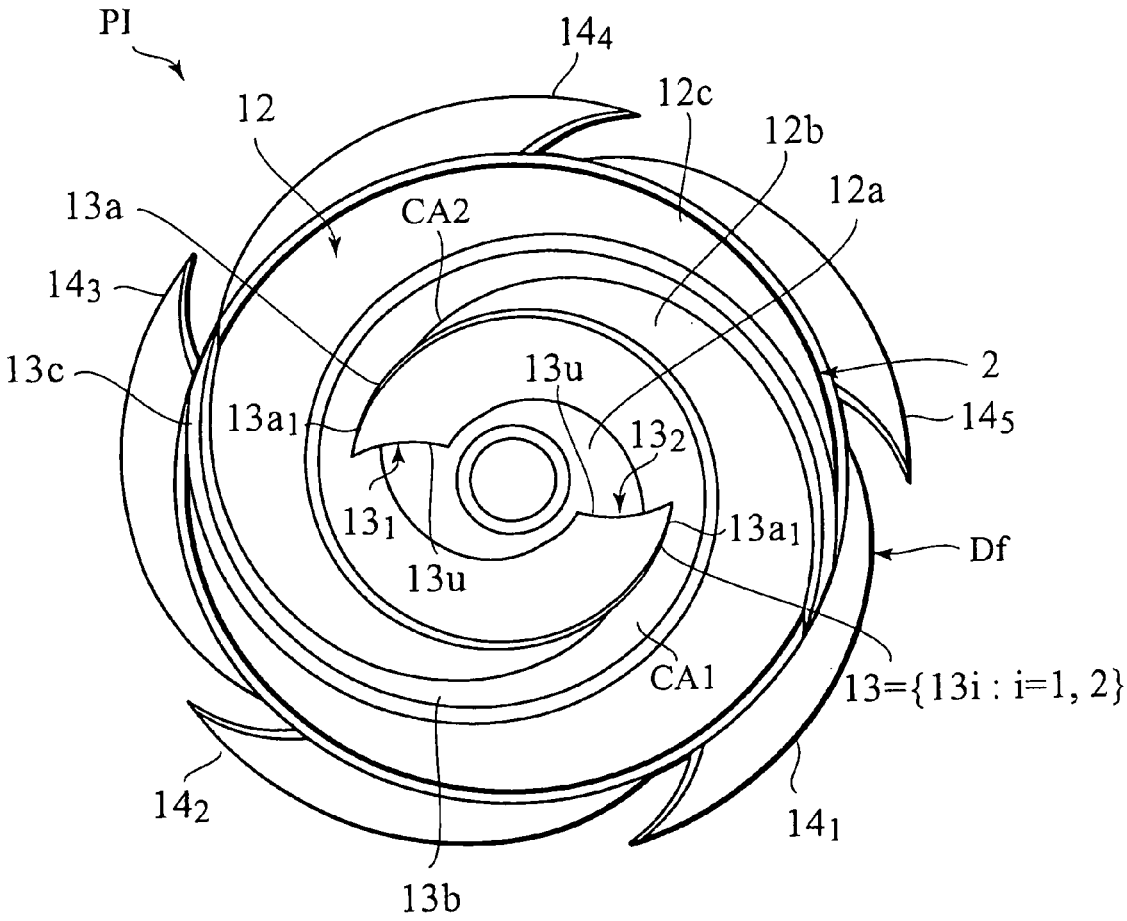
FIG. 5 is a front view of the essential portion of the pump of FIG. 4.

The water pumping portion 1A has the suction casing 9 as a rear shroud, and a two-vane impeller 2 as a front shroud rotatably inscribed in the casing 9, cooperating to define a pair of water pumping spiral rotary channels $CA_i$ (i=1, 2, see FIG. 5: hereafter collectively referred to CA). The water delivery portion 1B has the delivery casing 10, and a five-vane diffuser Df as a casting integrally molded with the casing 10 to bear a left part 5*b* of the spindle 5, cooperating to define a total number of five pumped water returning spiral stationary channels $CB_j$ (j=1~5, see FIG. 6: hereafter collectively referred to CB). The suction casing 9 and the delivery casing 10 have their meeting ends abutted and lap joined watertight, to be integrated as a pump casing 8 which is stepless. along the inside. Accordingly, the horizontal shaft pump 1 is configured with a structure having a rotary impeller 2 and a stationary diffuser Df accommodated in the casing 8 to define rotary channels CA and stationary channels CB. The rotary channels CA and the stationary channels CB are interconnected by a relatively wide volute of conflux channel CC. It therefore is difficult to imagine a case where foreign matter having passed through the straight pipe Sp and the rotary channels CA would block the conflux channel CC or stationary channels CB.

Figure 3:
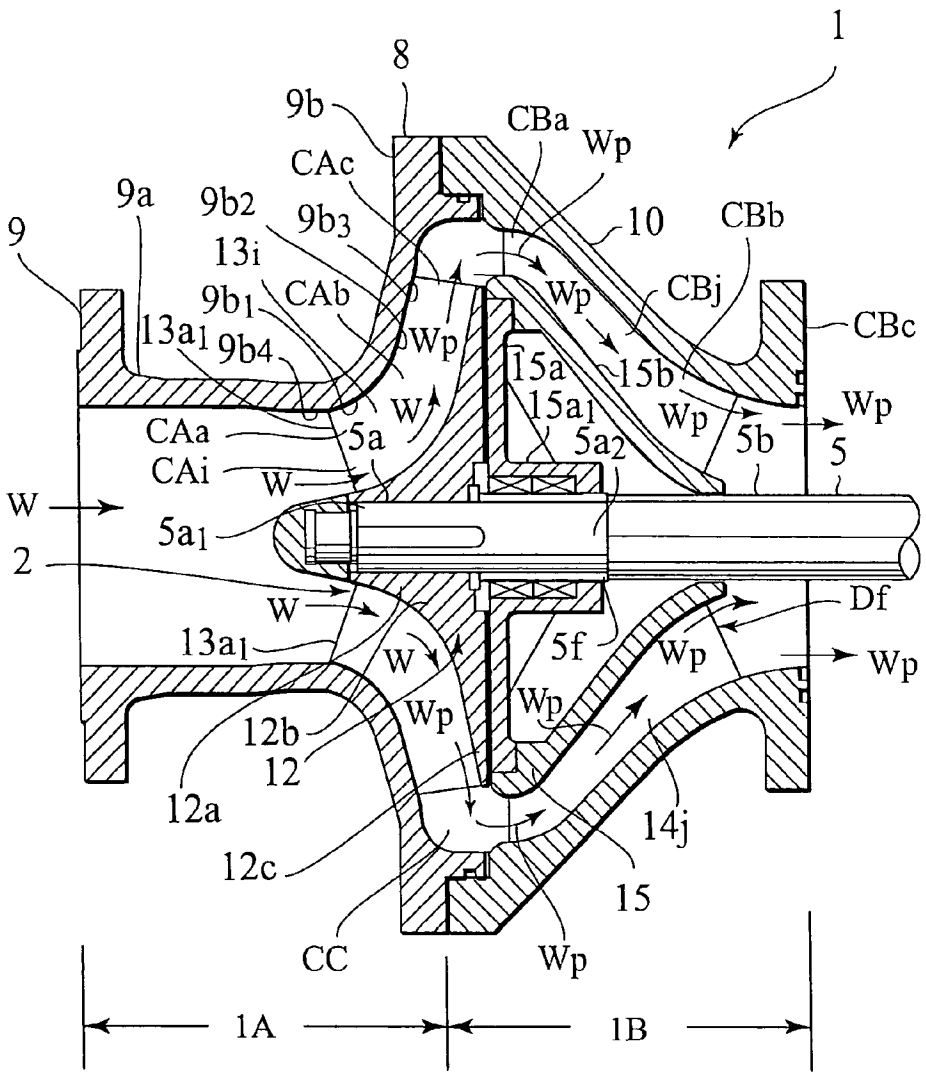
FIG. 3 is a longitudinal sectional side view, with channels shown in M-contour, of the turbopump provided in the piping of FIG. 2.
Figure 4:
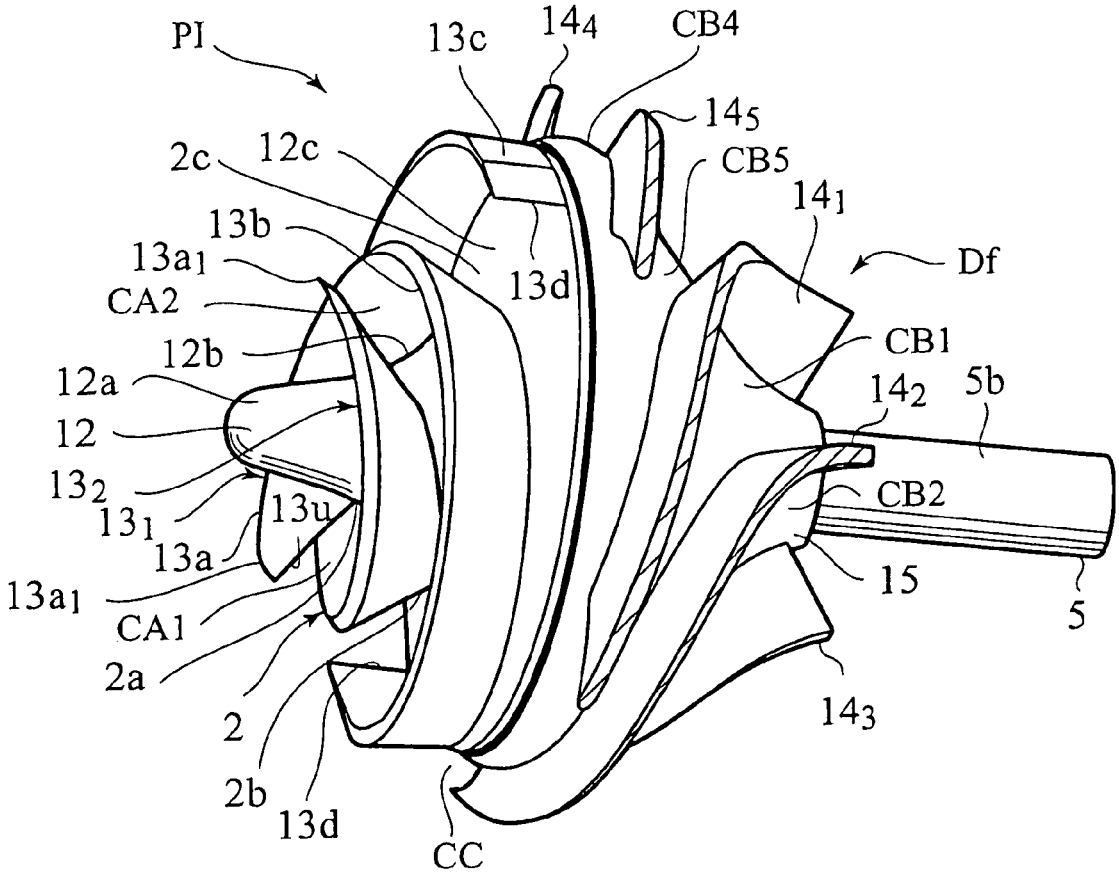
FIG. 4 is a perspective view of an essential portion of the turbopump of FIG. 3, including a spindle, a two-vane impeller fixed on the spindle, and a five-vane diffuser with a boss for bearing the spindle, with the diffuser being imaginarily cut off from a delivery casing of the pump.
Figure 6:
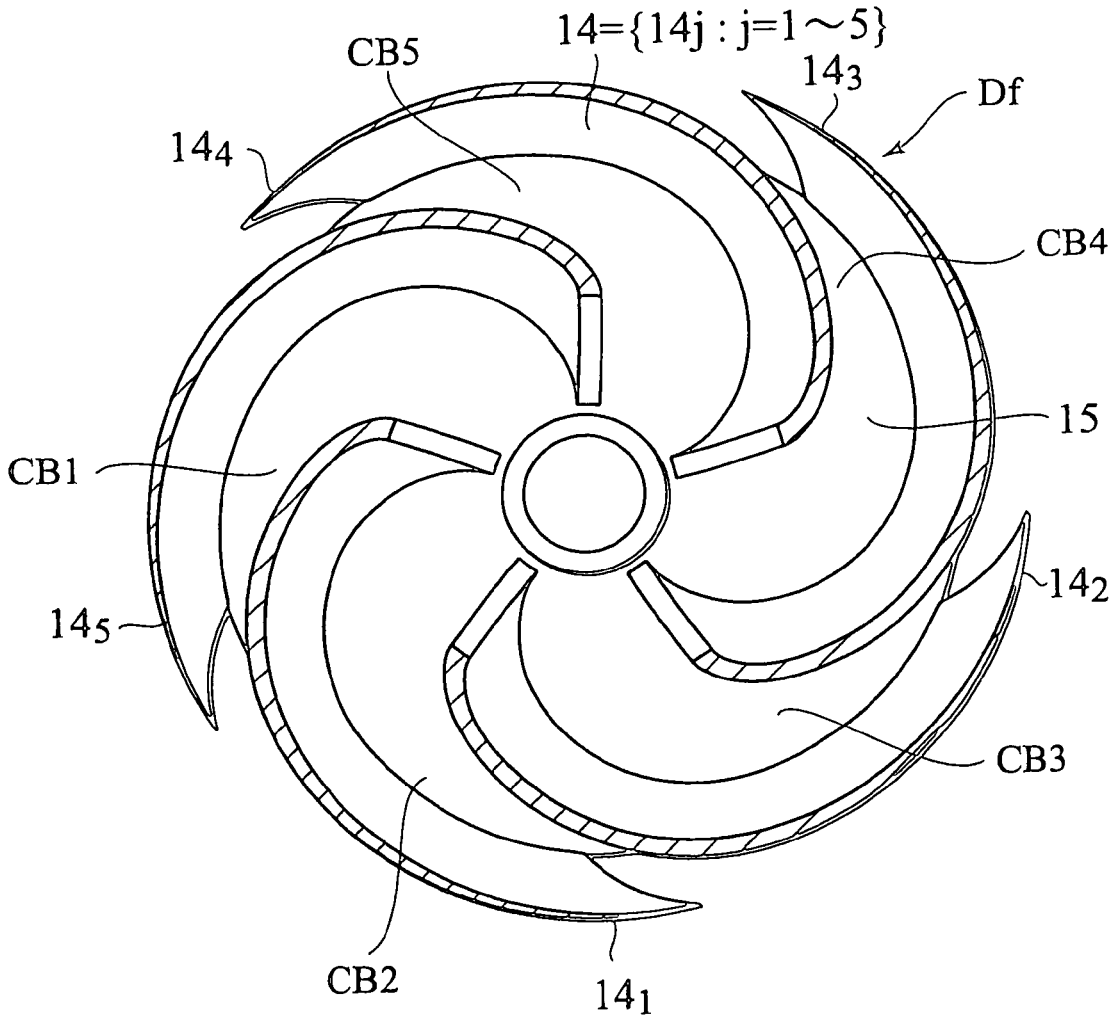
FIG. 6 is a rear view of the diffuser of FIG. 4.

FIG. 3 shows the horizontal shaft pump 1 in longitudinal section, with the channels CA and CB in M-contour, and FIGS. 4~6 show configuration of a pump interior PI including the impeller 2, diffuser Df, and spindle left part 5*b* (i.e., the rest of pump 1, as the casing 8 is cut and removed). FIG. 4 and FIG. 5 are perspective and front views of the pump interior PI, respectively, and FIG. 6 is a rear view of the diffuser Df. The diffuser Df is imaginarily cut off from the delivery casing 10.

As shown in FIG. 3, in the pump 1, each rotary channel $CA_i$ has, in its M(meridian)-map, an axial flow part CAa in which principal streams of water W called therein generally run in the axial direction of the spindle 5, a centrifugal part CAc at which principal streams of pumped liquid Wp run out generally in radial directions of the spindle 5, and a mixed flow part CAb which smoothly interconnects them CAa and CAc and in which principal streams of water W run diagonally to the spindle.

Each stationary channel $CB_j$ has, in its M-map, an influx part CBa which is made relatively large in diameter, but small in sectional area, to admit an inflow, at a relatively high speed, of equi-divided flux of pumped liquid Wp having swirling components, as it has been confluent once after tangential outflow from the rotary channels $CA_i$, a divergent channel part CBb which guides influent pumped liquid Wp to radially inwardly spirally flow in a diffusing manner, and an efflux part CBc which is made relatively small in diameter, but large in sectional area, to allow for pumped liquid Wp, as it is decreased in speed and increased in pressure depending on the degree of diffusion, to outflow along the spindle 5.

In this respect, the diffuser Df is configured with five spiral stationary guide vanes $14_j$ (J=1~5, see FIG. 6, hereafter collectively refereed to 14) as stationary blades that are integrated at their outer peripheral parts to the delivery casing 10 and have curved surfaces with a smoothly varying curvature over the length thereof, and a vane collecting boss 15 which is integrally formed with inner peripheral parts of the guide vanes 14. The boss 15 is made of a disc member 15*a* which is configured at a central tubular part 15*a*1 thereof for bearing a collar 5*f* fit to be fixed on a right half 5*a*2 of a small-diameter part 5*a* of the spindle, and a boss part 15*b* pear-shaped in contour, which is welded along whole circumference to the member 15*a*.

The stationary channels $CB_j$ are defined by an outer periphery of the boss 15, an inner periphery of the casing 10, and the stationary vanes $\mathbf{14}_j$ extending therebetween.

On the other hand, the impeller 2 is configured with a hub 12 funnel-shaped in contour, which is keyed to a left half 5*a*1 of the small-diameter part 5*a* provided at the left end of the spindle 5, and two spiral rotary vanes $\mathbf{13}_i$ (i=1, 2, see FIG. 5, hereafter collectively referred to 13) as mobile blades that are integrated to the hub 12 and have curved surfaces with a curvature smoothly varying over the length thereof.

The hub 12 of impeller 12 is contoured so as to have a nipple-shaped front part 12*a* formed with an outer periphery moderate in slope in side view (FIG. 3), a divergent rear part 12*c* formed with an outer periphery steep in slope in side view, and an intermediate part 12*b* for smooth connection between the front and rear parts 12*a* and 12*c*. Confronting the hub 12 is a right half 9*b* in the figure of the suction casing 9, which also has a horn-shaped front part 9*b*1 contoured with an inner periphery moderate in slope in side view (FIG. 3), a divergent rear part 9*b*3 contoured with an inner periphery steep in slope in side view, and an intermediate part 9*b*2 contoured for smooth connection between the front and rear parts 9*b*1 and 9*b*3.

The rotary channels $CA_i$ are defined by the outer periphery of the hub 12, the inner periphery of the casing's right half 9*b*, and the rotary vanes $\mathbf{13}_i$ extending therebetween.

More specifically, the axial flow part CAa of rotary channel CA is defined by the front part 12*a* of the hub 12, the front part 9*b*1 of the casing's right half 9*b* confronting the same 12*a*, and upstream screw parts 13*a* (FIGS. 4 and 5) of rotary vanes 13 extending therebetween, the mixed flow part CAb of the rotary channel CA is defined by the intermediate part 12*b* of the hub 12, the intermediate part 9*b*2 of the casing's right half 9*b* confronting the same 12*b*, and intermediate screw parts 13*b* (see FIGS. 4 and 5) of the rotary vanes 13 extending therebetween, and the centrifugal part CAa of the rotary channel CA is defined by the rear part 12*c* of the hub 12, the rear part 9*b*3 of the casing's right half 9*b* confronting the same 12*c*, and downstream screw parts 13*c* (see FIGS. 4 and 5) of the rotary vanes 13 extending therebetween. Further, the upstream screw parts 13*a* of rotary vanes 13 are extended to the suction end, thereby providing an inducer function.

In other words, as shown in FIG. 4, the impeller 2 has an axial flow portion 2*a* configured with the hub front part 12*a* and the upstream screw parts 13*a*, a mixed flow portion 2*b* configured with the hub intermediate part 12*b* and the intermediate screw parts 13*b*, and a centrifugal portion 2*c* configured with the hub rear part 12*c* and the downstream screw parts 13*c*, and besides, as shown in FIG. 3, the upstream screw parts 13*a* are configured at their suction end edges, so that the edge parts extend leftwards in the figure (i.e., toward the suction end), as they extend from the hub 12 side to the casing 9 side, making smooth connections (i.e., collisionlessly with continued curvatures) at outer peripheral edges thereof to sectorial main parts of the upstream screw parts 13*a*, whereby "continuously" formed inducer parts 13*a*1 are integrally provided. The inducer parts 13*a*1 have their extended ends reaching a vicinity of a straight tubular part 9*b*4 of the casing's right half 9*b*, while residing, in side view, at the righthand in the figure (i.e., delivery side) relative to a distal end of the hub front part 12*a*.

Although the upstream screw parts 13*a* constituting the impeller's axial flow portion 2*a* have axially slanted sections, the downstream screw parts 13*c* constituting the impeller's centrifugal portion 2*c* have their sections substantially extending in radial directions of the spindle 5, and the intermediate screw portions 13*b* constituting the impeller's mixed flow portion 2*b* are somewhat inclined for smooth connection therebetween. Accordingly, when induced via the inducer parts 13*a*1 into the rotary channels CA, the water W is first axially forced therein, as it receives pumping forces from vane faces of the upstream screw parts 13*a*. Then, the water W forced in under pressure is pressurized, as it receives pumping forces from vane faces of the intermediate screw parts 13*b*, while being swirled, having centrifugal forces, and accelerated therewith along the vanes. Then, as it is swirled by the downstream screw parts 13*c*, having great centrifugal forces, it's speed accelerates further therewith along the vanes.

There will be given below comprehensive description of dimensions and functions of turbopumps according to the preferred embodiments of the invention, based on FIG. 7~FIG. 11, with illustrative reference to configuration of the first embodiment. There will then be made occasional reference to FIG. 12~FIG. 14, FIG. 15~FIG. 17, FIG. 18~FIG. 20, and FIG. 21~FIG. 23 showing the first, the second, the third, and the fourth modification of the first embodiment, respectively, accompanied by associated description, for simplification of description of the modifications.

Figure 7:
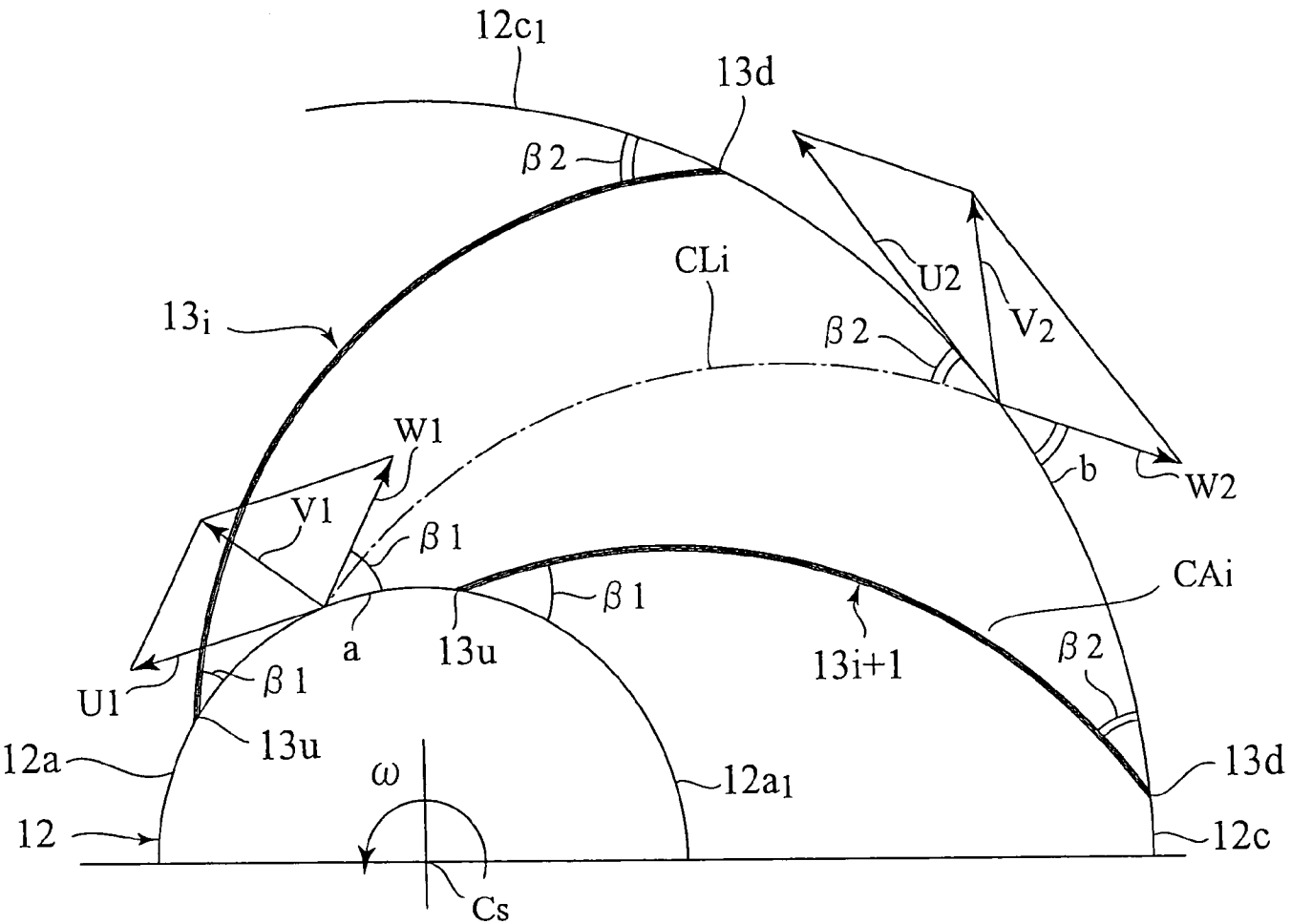
FIG. 7 is a schematic diagram for comprehensive illustration of pumps according to embodiments of the invention to show relationships between vane angles and parameters of flow fields at a vane inlet and a vane outlet of an exemplary impeller having a plurality of vanes.

FIG. 7 is a diagram showing relationships between vane angles and parameters of the field of flow at an inlet and an outlet of a channel $CA_i$ ($CA_1$ or $CA_2$ in the first embodiment) that is defined between neighboring vanes $\mathbf{13}_i$ and $\mathbf{13}_{i+1}$, among arbitrary I (I=2~4 for the invention, I=2 for the first embodiment) impeller vanes $\{\mathbf{13}_i$: i=1~I$\}$ according to embodiments of the invention (more specifically, a front view of the hub 12, as the channel $CB_i$ is projected on an outer peripheral side of the hub 12).

The rotary channel $CA_i$ defined between the rotary vanes $\mathbf{13}_i$ and $\mathbf{13}_{i+1}$ has an opening "a" (hereafter called "vane inlet") defined as a concave surface by upstream end edges 13*u* and 13*u* (see FIGS. 4 and 5) of the vanes $\mathbf{13}_i$ and $\mathbf{13}_{i+1}$ and an outer periphery 12*a*1 of the hub front part 12*a* crossing them, an opening "a" (hereafter called "vane inlet") defined as a concave curved surface by upstream end edges 13*u* and 13*u* (see FIGS. 4 and 5) of the vanes 13*i* and $\mathbf{13}_{i+1}$ and an outer circumference 12*a*1 of the hub front part 12*a* crossing them, and an opening "b" (hereafter called "vane outlet") defined as a convex curved surface by downstream end edges 13*d* and 13*d* (see FIGS. 4 and 5) of the vanes $\mathbf{13}_i$ and $\mathbf{13}_{i+1}$ and an outer circumference 12*c*1 of the hub rear part 12*c* crossing them. At the vane inlet "a" and at the vane outlet "b", each vane $\mathbf{13}_i$ (more specifically, a tangent plane thereto) crosses surfaces of the openings (more specifically, such tangent planes that are tangent to corresponding hub outer circumferences 12*a*1 and 12*c*1 and extend in the axial direction of the hub 12) at predetermined angles $\beta_1$ and $\beta_2$ in front view, which are called "vane inlet angle" and "vane outlet angle", respectively. For the pumps to be rotationally symmetric, the vane inlet angle $\beta_1$ is equal to an angle at which a centerline $CL_i$ of the channel $CA_i$ projected on the hub outer periphery intersects the hub outer circumference 12*a*1 at the vane inlet "a", and the vane outlet angle $\beta_2$ is equal to an angle at which the centerline $CL_i$ of the channel $CA_i$ projected on the hub outer periphery intersects the hub outer circumference 12*c*1 at the vane outlet "b".

Description is now made of dimensions at the vane inlet of impeller 2, and associated parameters.

It is noted that, in the embodiments, the vane inlet angle $\beta_1$ is set to 14° so as to be relatively small irrespective of the thickness of vane 13, thereby allowing a large opening area at the vane inlet "a" to provide the impeller 2 with enhanced suction performance.

In the pumps 1, the rotary channels $CA_i$ are rotated about an axis Cs of the spindle 5, at an angle ω to be identical to a rotation angle of the impeller 2, while principal streams of water W in each channel $CA_i$ run substantially in parallel to the centerline $CL_i$ of the channel $CA_i$ being rotated. Accordingly, letting vectors u1, and w1 and v1 be a velocity of outer circumference, and a fluid velocity and an absolute velocity of water W at the vane inlet of impeller 2, respectively, and vectors u2, and w2 and v2 be a velocity of outer circumference, and a fluid velocity and an absolute velocity of water W at the vane outlet of impeller 2, respectively, relationships are established, such that:

$$v1=w1+u1 \quad \text{(expression-1), and}$$

$$v2=w2+u2 \quad \text{(expression-2).}$$

Figure 8:
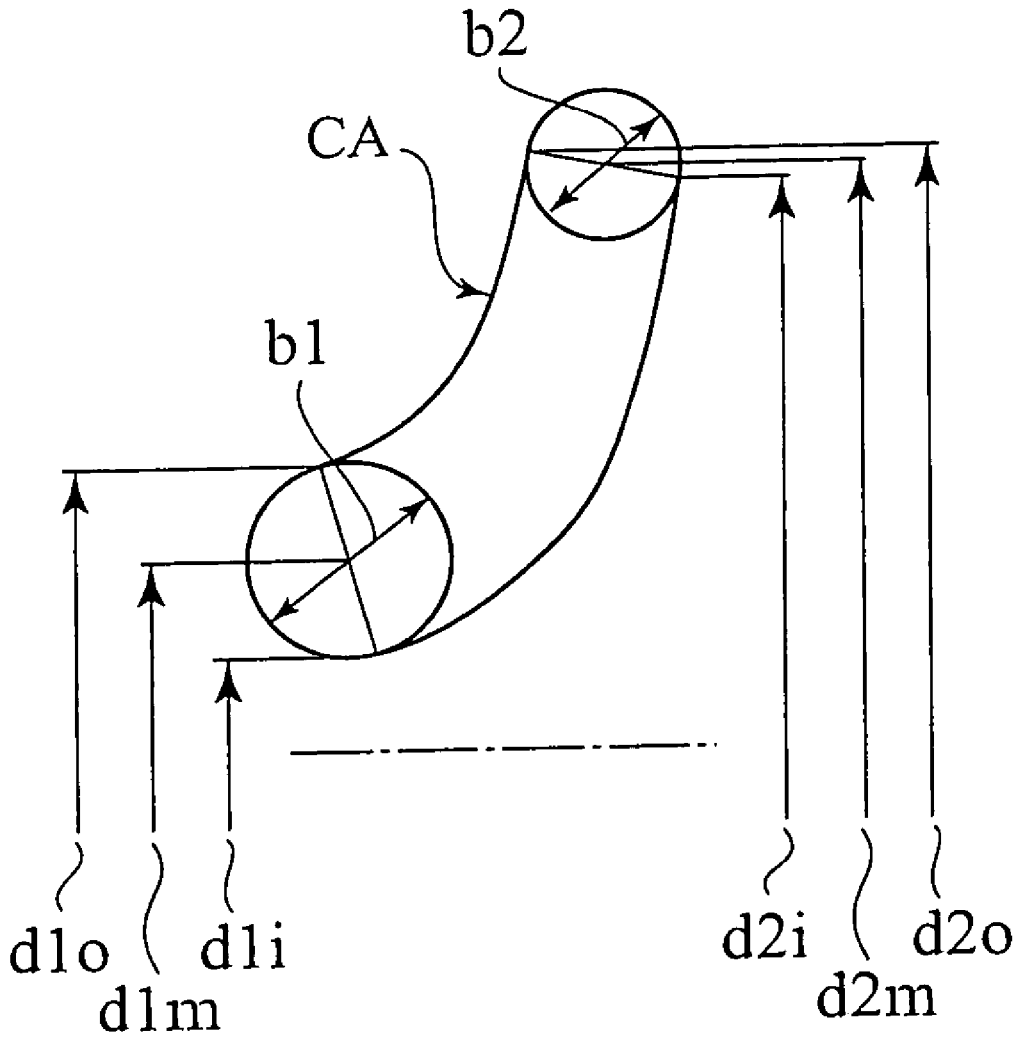
FIG. 8 is a diagram for comprehensive illustration, with channels shown in M-contour between a pump casing and an impeller, to show channel dimensions and impeller dimensions at an inlet and an outlet of the channels, for pumps according to embodiments of the invention.

FIG. 8 shows, in M-contour, a respective one of rotary channels CA to be defined between the impeller 2 and the pump casing 8 of horizontal shaft pumps 1 according to embodiments of the invention.

The rotary channel CA has, at the vane inlet, a channel width $b_1$ (i.e., the pitch of vanes 13), an impeller outer circumference diameter $d_{1o}$ (i.e., the diameter of a pitch circle of outside edges of vanes 13), an impeller center diameter $d_{1m}$ (i.e., the diameter of a pitch circle of channel centerlines CL), and an impeller inner circumference diameter $d_{1i}$ (i.e., the diameter of outer circumference of hub 12), and at the vane outlet, a channel width $b_2$, an impeller outer circumference diameter $d_{2o}$, an impeller center diameter $d_{2m}$, and an impeller inner circumference diameter $d_{2i}$.

For specific speed $n_s$, connection diameter d, delivery flow rate Q, total head H, and number of revolutions n of horizontal shaft pumps 1, their exemplary specifications are set, as follows:

$n_s=200\ \text{min}^{-1}\cdot(\text{m}^3/\text{min})^{1/2}\cdot\text{m}^{-3/4}$, d=ϕ150 mm, Q=2 $\text{m}^3$/min, H=28 m, and n=1750 $\text{min}^{-1}$.

Principal streams have a meridian velocity $c_{m1}$ (a velocity of flux of water in M-map, hereafter called "M-velocity") at the vane inlet of impeller 2, which conventionally is calculated by the following expression:

$$c_{m1}=K_{m1}\cdot\sqrt{2gH} \quad \text{(expression-3),}$$

where $K_{m1}$ is a velocity coefficient at the vane inlet, to be determined from a Stepanoff diagram, and g is the acceleration of gravity.

From the pump specifications, the total head H=28 m. For the specific speed $n_s$, as a value is given, this value can be used to determine $K_{m1}$ from the Stepanoff diagram, such that $K_{m1}$=0.155. Conventionally, therefore, the M-velocity $c_{m1}$ at the vane inlet might have been calculated from expression-3 such that:

$$c_{m1}=0.155\cdot\sqrt{2g\cdot 28}=3.6\ \text{m/s}.$$

Regarding this point, in the embodiments, an M-velocity $c_{m1}$ at the vane inlet of impeller 2 is set to 2.5 m/s to be smaller than is conventional, in order to improve suction performance.

Each rotary channel CA of the impeller 2 shown in FIG. 7 has a sectional area $A_0$ at the vane inlet, which has a relationship to dimensions shown in FIG. 8, assuming an effective sectional area A of the channel CA in consideration of a thickness of rotary vane 13, such that:

$$A_0=\pi\left(\frac{d_{1o}+d_{1i}}{2}\right)\cdot b_1, \text{ and} \quad \text{(expression-4)}$$

$$A=A_0\cdot k_1 \quad \text{(expression-5),}$$

where $k_1$ is an effective area ratio, and $k_1$=0.895 in the embodiments.

On the other hand, the effective sectional area A assumed at the vane inlet of each channel CA of impeller 2 should have a relationship to the (incompressible) delivery flow Q of pumps 1 such that:

$$A=Q/c_{m1} \quad \text{(expression-6).}$$

As the flow rate Q is given in the pump specifications, and the M-velocity $c_{m1}$ at the vane inlet is set, the effective sectional area A of each channel CA can be determined from expression-6, allowing the channel area $A_0$ to be calculated from expression-5, the result of which is accommodated to the specification (0.15 m) of the pump connection diameter d by determining the impeller outer circumference diameter $d_{1o}$, impeller center diameter $d_{1m}$, and impeller inner circumference diameter $d_{1i}$ at the vane inlet, as follows:

$d_{1o}$=0.144 m, $d_{1m}$=0.108 m, and $d_{1i}$=0.052 m.

The channel width $b_1$ at the vane inlet is set to 33% of the impeller outer circumference diameter $d_{1o}$, so that:

$b_1$=0.048 m.

At the vane inlet, the impeller 2 has a circumferential speed $u_{1m}$ with respect to the center diameter $d_{1m}$, which speed $u_{1m}$ is related to the number n of revolutions of pumps as follows:

$$u_{1m}=d_{1m}\cdot\pi\cdot\frac{n}{60}. \quad \text{(expression-7)}$$

As in the pump specifications, the pump revolution number n=1750 $\text{min}^{-}$, which provides a circumferential speed value $u_{1m}$, such that:

$$u_{1m}=0.108\cdot\pi\cdot\frac{1750}{60}=9.9\ \text{m/s}.$$

For water flow to be collisionless at the vane inlet, the vane inlet angle $\beta_1$ neglecting the thickness of vane 13 should meet the following condition:

$$\beta_1 = \tan^{-1}\left(\frac{c_{m1}}{u_{1m}}\right). \quad \text{(expression-8)}$$

As $c_{m1}$=2.5 m/s, and $u_{1m}$=9.9 m/s, it so follows that:

$$\beta_1 = \tan^{-1}\left(\frac{2.5}{9.9}\right) = 14°.$$

Neighboring vanes $\mathbf{13}_i$ and $\mathbf{13}_{i+1}$ of impeller 2 have a distance $b_{1z}$ therebetween, which can be determined for a particular number z(=I) of vanes 13, as follows:

$$b_{1z} = \left(\frac{\pi d_{1m}}{z}\right)\sin\beta_1. \quad \text{(expression-9)}$$

For z=2 (see FIG. 5, FIGS. 18~20, and FIGS. 21~23), calculating expression-9, $b_{1z}$=0.041 m, which is 0.28 (i.e., 28%) in proportion $b_{1z}/d_{1o}$ to the impeller outer circumference diameter $d_{1o}$ at the vane inlet.

For z=3 (see FIGS. 12~14), $b_{1z}$=0.027 m, and $b_{1z}/d_{1o}$=0.19.

For z=4 (see FIGS. 15~17), $b_{1z}$=0.021 m, and $b_{1z}/d_{1o}$=0.14.

The vane number z may better be reduced in order to secure a passable particle diameter for the channel CA, and to prioritize the suction performance of impeller 2.

In this respect, if the vane number z is 2 (see FIG. 5, FIGS. 18~20, and FIGS. 21~23), having 28% as the ratio ($b_{1z}/d_{1o}$) of inter-vane distance to impeller outer circumference diameter at the vane inlet, the rotary vanes 13 can be formed continuously up to the vane outlet, as the vane inlet angle $\beta_1$ is set to 14°, thus allowing the passable particle diameter to be secured and the suction performance prioritized.

If the vane number z is 3 (see FIGS. 12~14), still having 19% as the ratio ($b_{1z}/d_{1o}$) of inter-vane distance to impeller outer circumference diameter at the vane inlet, there can be formed rotary vanes to be continuous from the vane inlet to the vane outlet, subject to a setting of specification for pump connection diameter d to be 200 mm or more, thus allowing the passable particle diameter to be secured while prioritizing the suction performance.

If the vane number z is 4 (see FIGS. 15~17), yet having 14% as the ratio ($b_{1z}/d_{1o}$)) of inter-vane distance to impeller outer circumference diameter at the vane inlet, there can be formed rotary vanes to be continuous from the vane inlet to the vane outlet, subject to a setting of specification for pump connection diameter d to be 300 mm or more, thus allowing the passable particle diameter to be secured and the suction performance prioritized.

Therefore, in pumps large of connection diameter, the impeller may have a vane number set to three or four and an increased number of revolutions to enable the enhancement of suction performance, allowing for operation at high head and large delivery.

As the vane number of impeller is set to three or four, energy transmission to fluid can be efficient, with a commensurate contribution to decrease the impeller outer circumference diameter and increase the vane outlet angle.

Description is now made of the dimensions at the vane inlet of impeller 2, and associated parameters.

It is noted that, in conventional centrifugal pumps, the vane outlet angle $\beta_2$ is generally set to $\beta_2$=15°~25°. This is based on the number of vanes presumed within 5~8, failing to suppose a vane number within 2~4.

Regarding this point, an examination is made below without consideration to the vane thickness and the occurrence of leakage.

At the vane outlet of impeller, the flow has a circumferential velocity $u_{2m}$ at the center diameter $d_{2m}$, which is determined, assuming a velocity coefficient $k_{u2m}$ (=1.01), such that:

$$u_{2m}=k_{u2m}\sqrt{2gh} \quad \text{(expression-10).}$$

Calculating this, $$u_{2m}=1.01\sqrt{2g\cdot 28}=23.7 \text{ m/s.}$$

On the other hand, the center diameter $d_{2m}$ at the vane outlet of impeller is determined by the following expression:

$$d_{2m}=60\ u_{2m}/\pi\cdot n \quad \text{(expression-11).}$$

Calculating this, $$d_{2m}=60\times 23.7/\pi\times 1750=0.259 \text{ m.}$$

With respect to the center diameter $d_{2m}$ at the vane outlet of impeller, an M-velocity $c_{m2}$ is determined, assuming a velocity coefficient $k_{m2}$ (=0.113), such that:

$$c_{m2}=k_{m2}\sqrt{2gH} \quad \text{(expression-12).}$$

Calculating this, $$k_{m2}=0.113\sqrt{2g\cdot 28}=2.65 \text{ m/s.}$$

Further, the channel width $b_2$ with respect to the center diameter $d_{2m}$ at the vane outlet of impeller is determined by the following expression:

$$b_2=Q/\pi d_{2m}\cdot c_{m2} \quad \text{(expression-13).}$$

Calculating this, $$b_2=(2/60)/\pi\times 0.259\times 2.65=0.015 \text{ m.}$$

Conventionally, therefore, with respect to the outer circumference diameter $d_{1o}$=0.144 m at the vane inlet of impeller, the channel width $b_2$=0.015 m at the vane outlet has a proportion of 10%, which is not enough to secure a sufficient passable particle diameter.

When compared with an infinite number of vanes, the definite numbers of vanes have their head losses, which will be discussed below. Letting $H_{th}$ be a theoretical head by a definite number of vanes $\mathbf{13}_i$, $H_\infty$ be a theoretical head by an infinite number of vanes, and $c_{u2\infty}$ be an M-velocity at a vane inlet of the infinite number of vanes, the loss in use of the definite number of vanes can be expressed in terms of a slipping coefficient x, such that:

$$x = \frac{H_{th}}{H_\infty} = 1 - \frac{c_{u2}}{c_{u2\infty}}\cdot\frac{\pi\sin\beta_2}{z}. \quad \text{(expression-14)}$$

The lower the vane number z, the greater the increase in the denominator in the second term at the right side of espression-14, resulting in a problem of a commensurate approach of slipping coefficient x to 1.

To cope with this problem, according to the invention, the vane outlet angle $\beta_2$ of the impeller 2 is set to be small.

In this respect, the theoretical head $H_\infty$ by the indefinite number of vanes depends on a cirumferential velocity $u_2$ and a radial velocity $c_{u2}$ of flow at the vane outlet of impeller 2

(with a channel sectional area $d_{2m} \cdot b_2$), as well as on the vane outlet angle $\beta_2$, presuming no swirl at the vane inlet, such that:

$$H_\infty = \frac{1}{g} c_{u2} \cdot u_2 = \frac{1}{g} u_2 \left( u_2 - \frac{c_{m2}}{\tan \beta_2} \right). \quad \text{(expression-15)}$$

Therefore, in the respective embodiments, in order to allow the channel width $b_2$ at the vane outlet to be large enough so as to decrease the loss due to slipping, while securing the passable particle diameter, as necessary, the impeller center diameter $d_{2m}$ at the vane outlet is set large, in addition to the vane outlet angle $\beta_2$ being set small. More specifically, the channel width $b_2$ at the vane outlet is set to 26% (i.e., $b_2$=0.038 m) in proportion to the outer circumference diameter $d_{1o}$=0.144 m at the vane inlet of impeller 2, thereby securing a passable particle diameter.

Because the outer circumference diameter $d_{1o}$=0.144 m at the vane inlet and the channel width $b_2$=0.038 m at the vane outlet of impeller 2, it so follows in the case of two vanes (see FIG. 5, FIGS. 18~20, and FIGS. 21~23), that the impeller center diameter $d_{2m}$=0.290 m at the vane outlet and the vane outlet angle $\beta_2$=10°.

In the case of three vanes (see FIGS. 12~14), the impeller center diameter $d_{2m}$=0.281 m at the vane outlet and the vane outlet angle $\beta_2$=11.8°.

In the case of four vanes (see FIGS. 15~17), the impeller center diameter $d_{2m}$=0.273 m at the vane outlet and the vane outlet angle $\beta_2$=11.8°.

In the embodiments, therefore, when compared with a conventional centrifugal pump, the impeller center diameter $d_{2m}$ at the vane outlet is greater by 5.4%~12%, and the vane outlet angle $\beta_2$ is 2~2.5 times greater, thereby allowing the configuration with 2~4 rotary vanes having a vane angle continuously and moderately varying from the inlet angle $\beta_1$=14° to an outlet angle $\beta_2$=10°~11.8°.

The number of vanes may well be set to 3 or 4 to achieve efficient energy transmission to the fluid, thereby facilitating a reduction of the impeller outside diameter and an increase in the vane outlet angle.

The center diameter $d_{2m}$ at the vane outlet of impeller 2 is variable within a range of 0.273 m~0.290 m called a "centrifugal region", where the channel width $b_2$ can be kept constant even when the vane number is changed from 2 to 3 or 4. For example, the channel width at the vane outlet may be set so that $b_2$=38 mm, thus having a proportion of 26% to the outer circumference diameter $d_{1o}$=0.144 m at the vane inlet of impeller 2, to ensure a sufficient passable particle diameter. In the case of pumps of a large connection diameter, the vanes of the impeller may be 3 or 4 in number, continuously formed from the inlet to the outlet, so that, while prioritizing the suction performance, a passable particle diameter can be secured.

Returning now to the first embodiment (FIG. 1~FIG. 6), the impeller 2 has two rotary vanes 13 wound on the hub 12, that are continuous from the upstream screw parts 13*a* formed as their starting ends with a vane inlet angle $\beta_1$ set to 14° to the downstream screw parts 13*c* formed as their finishing ends with a vane outlet angle $\beta_2$ set to 10°. The respective rotary channels CA defined by those rotary vanes 13 have a channel width $b_2$ at the vane outlet having a proportion of 26% of the outer circumference diameter at the vane inlet of impeller 2, thus allowing the vane angle to smoothly vary from the inlet to the outlet, and securing a sufficient passable particle diameter.

Of the pump 1 according to the first embodiment in which the number of rotary vanes $\mathbf{13}_i$ of the impeller 2 is two (I=2) and the number of stationary vanes $\mathbf{14}_j$ of the diffuser Df is five (J=5), the vane number(s) can be modified so that I is increased to I=3 or I=4 and/or J is decreased to J=4 or J=3, while keeping the proportion of the channel width $b_2$ at the vane outlet to the outer circumference diameter at the vane inlet of impeller at 26%. Such modifications will be described below.

Figure 12:
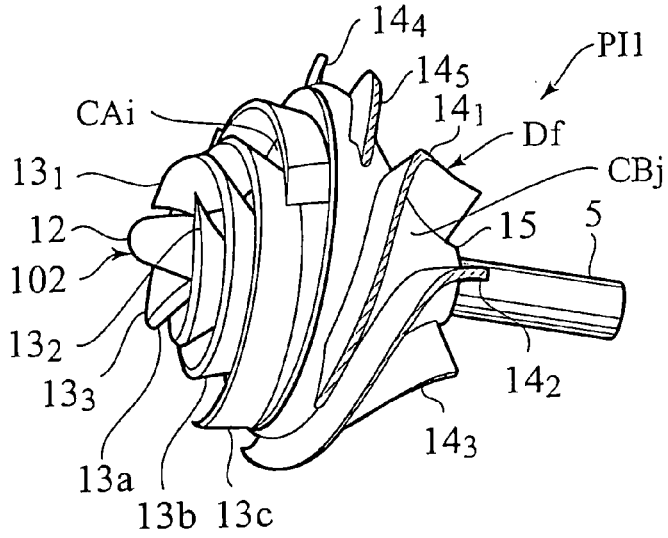
FIG. 12 is a perspective view of an essential portion of a turbopump according to a first modification of the first embodiment, including a spindle, a three-vane impeller fixed on the spindle, and a five-vane diffuser with a boss for bearing the spindle, with the diffuser being imaginarily cut off from a delivery casing of the pump.
Figure 13:
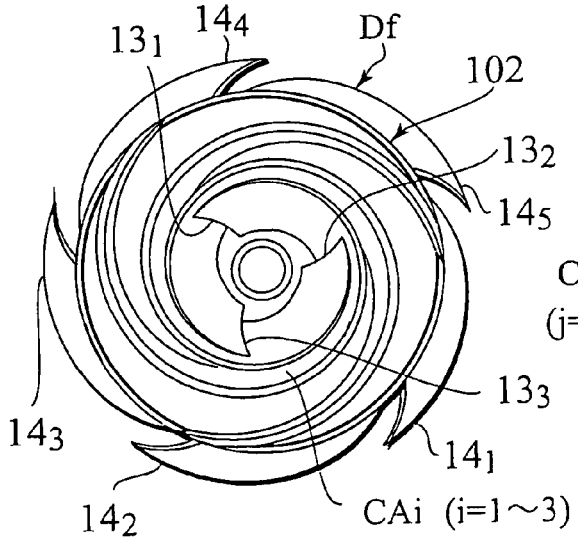
FIG. 13 is a front view of the essential portion of the pump of FIG. 12.
Figure 14:
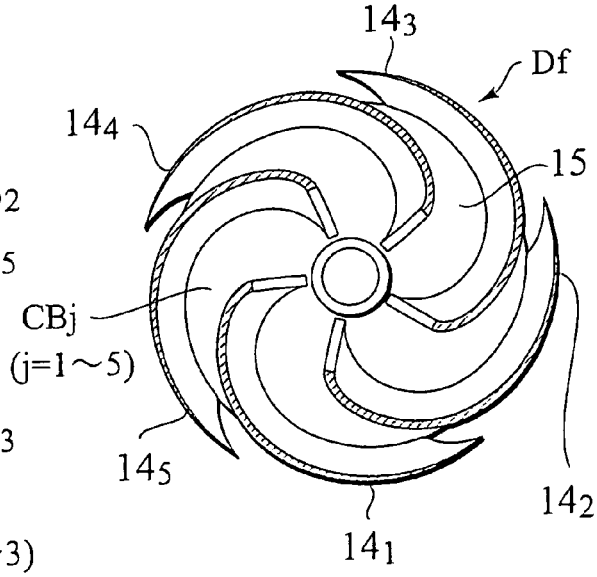
FIG. 14 is a rear view of the diffuser of FIG. 12.

FIG. 12~FIG. 14 show an essential portion PI1 of a turbopump according to a first modification of the first embodiment. This pump includes a spindle 5, an impeller 102 having a total number of three (I=3) rotary vanes $13_i$ (i=1~3) fixed on the spindle 5, and a diffuser Df having a total number of five (J=5) stationary vanes $14_j$ (j=1~5) and being provided with a boss 15 for bearing the spindle 5. The rotary vanes $13_i$ have a vane inlet angle $\beta_1$ set to 14°, and a vane outlet angle $\beta_2$ set to 11.1°.

Figure 15:
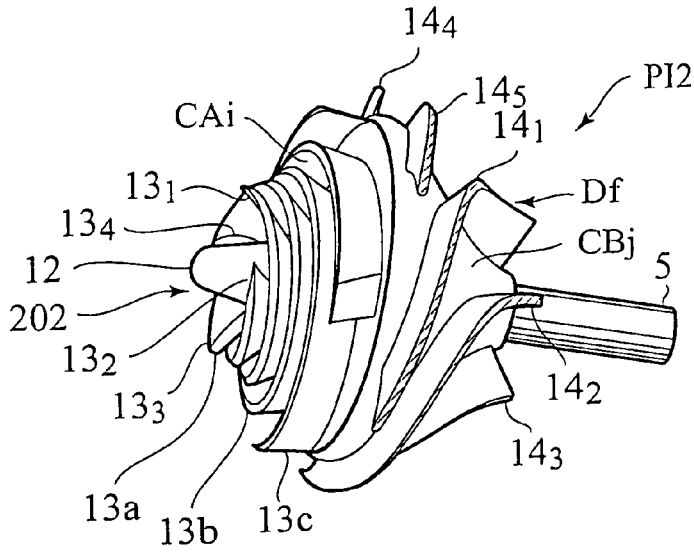
FIG. 15 is a perspective view of an essential portion of a turbopump according to a second modification of the first embodiment, including a spindle, a four-vane impeller fixed on the spindle, and a five-vane diffuser with a boss for bearing the spindle, with the diffuser being imaginarily cut off from a delivery casing of the pump.
Figure 16:
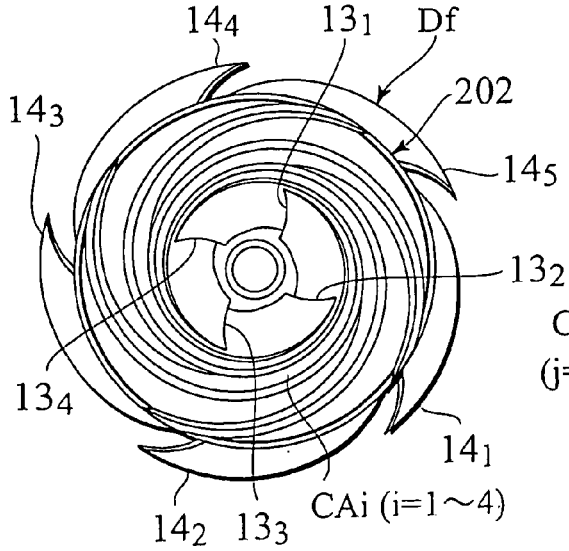
FIG. 16 is a front view of the essential portion of the pump of FIG. 15.
Figure 17:
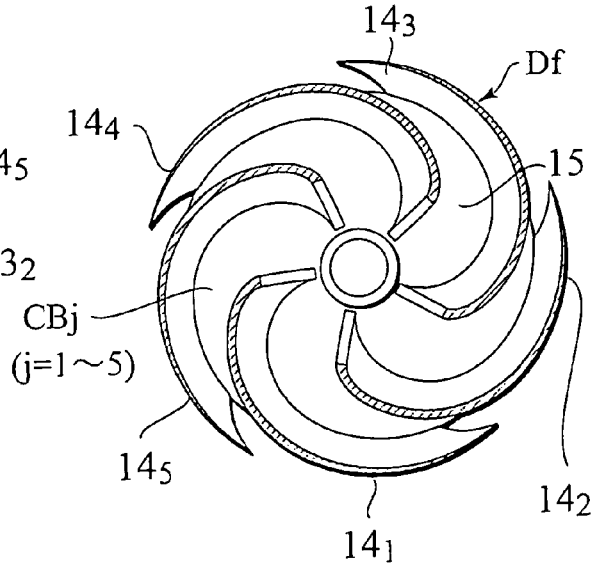
FIG. 17 is a rear view of the diffuser of FIG. 15.

FIG. 15~FIG. 17 show an essential portion PI2 of a turbopump according to a second modification of the first embodiment. This pump includes a spindle 5, an impeller 202 having a total number of four (I=4) rotary vanes $\mathbf{13}_i$ (i=1~4) fixed on the spindle 5, and a diffuser Df having a total number of five (J=5) stationary vanes $\mathbf{14}_j$ (j=1~5) and being provided with a boss 15 for bearing the spindle 5. The rotary vanes $\mathbf{13}_i$ have a vane inlet angle $\beta_1$ set to 14°, and a vane outlet angle $\beta_2$ set to 11.8°.

Figure 18:
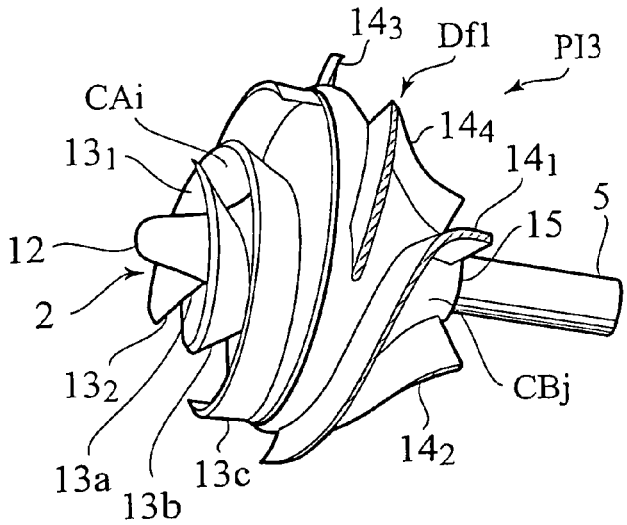
FIG. 18 is a perspective view of an essential portion of a turbopump according to a third modification of the first embodiment, including a spindle, a two-vane impeller fixed on the spindle, and a four-vane diffuser with a boss for bearing the spindle, with the diffuser being imaginarily cut off from a delivery casing of the pump.
Figure 19:
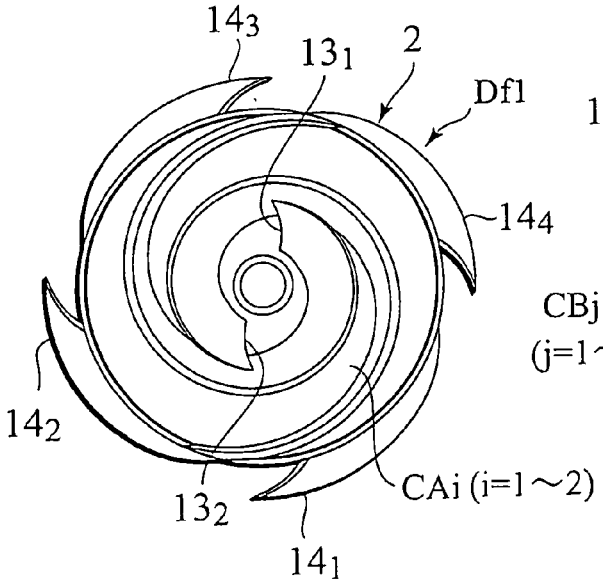
FIG. 19 is a front view of the essential portion of the pump of FIG. 18.
Figure 20:
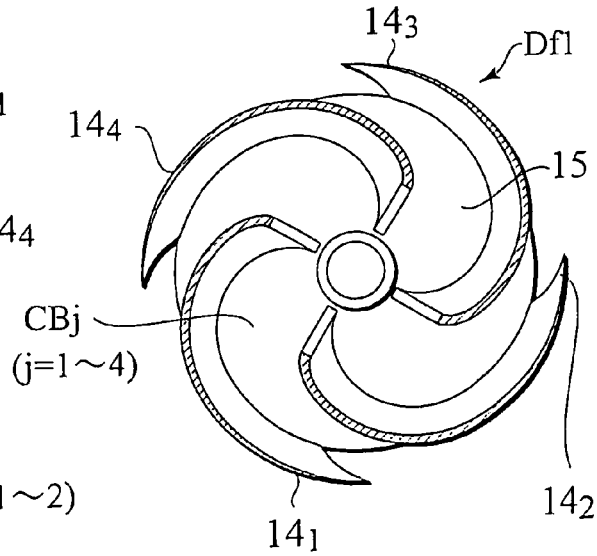
FIG. 20 is a rear view of the diffuser of FIG. 18.

FIG. 18~FIG. 20 show an essential portion PI3 of a turbopump according to a third modification of the first embodiment. This pump includes a spindle 5, an impeller 2 having a total number of two (I=2) rotary vanes $13_i$ (i=1~2) fixed on the spindle 5, and a diffuser Df1 having a total number of four (J=4) stationary vanes $\mathbf{14}_j$ (j=1~4) and being provided with a boss 15 for bearing the spindle 5. The rotary vanes $\mathbf{13}_i$ have a vane inlet angle $\beta_1$ set to 14°, and a vane outlet angle $\beta_2$ set to 10°.

Figure 21:
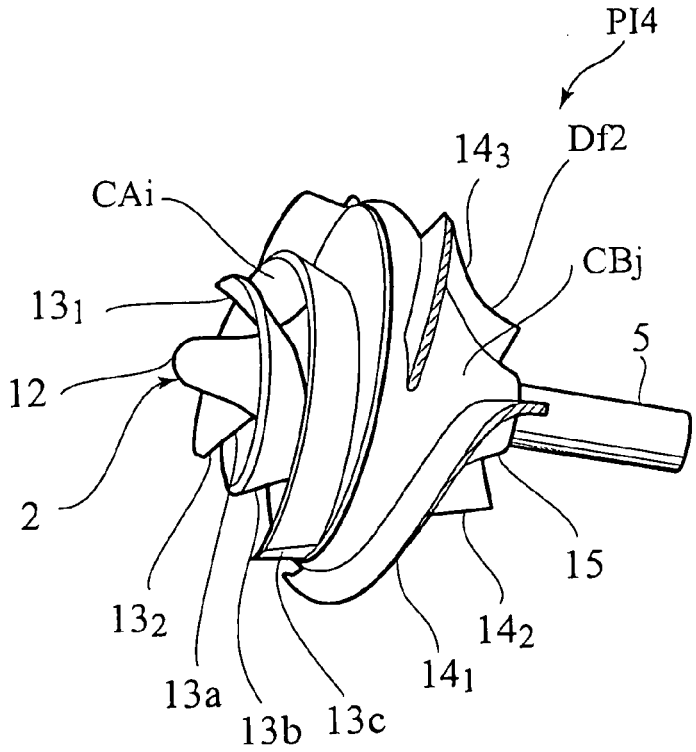
FIG. 21 is a perspective view of an essential portion of a turbopump according to a fourth modification of the first embodiment, including a spindle, a two-vane impeller fixed on the spindle, and a three-vane diffuser with a boss for bearing the spindle, with the diffuser being imaginarily cut off from a delivery casing of the pump.
Figure 22:
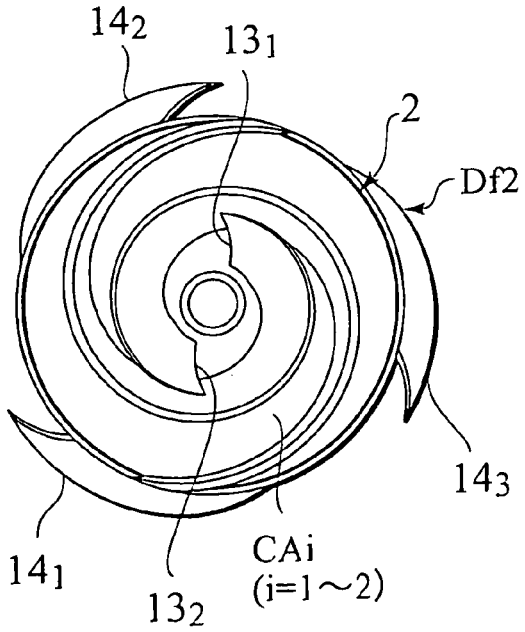
FIG. 22 is a front view of the essential portion of the pump of FIG. 21.
Figure 23:
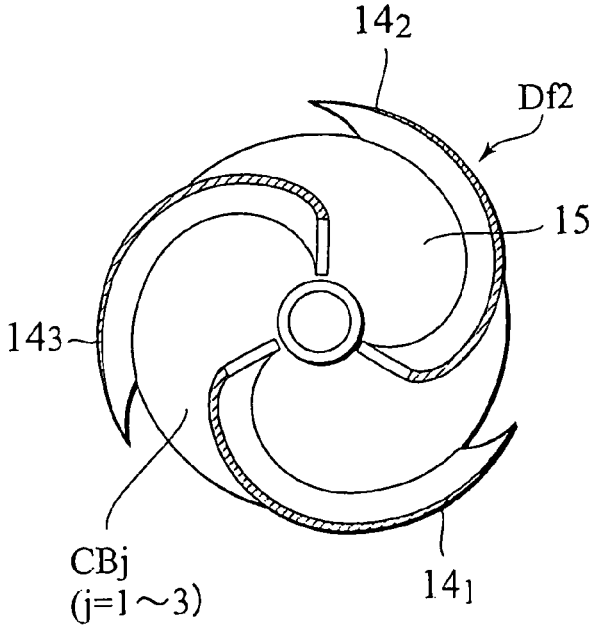
FIG. 23 is a rear view of the diffuser of FIG. 21.

FIG. 21~FIG. 23 show an essential portion PI4 of a turbopump according to a fourth modification of the first embodiment. This pump includes a spindle 5, an impeller 2 having a total number of two (I=2) rotary vanes $\mathbf{13}_i$ (i=1~2) fixed on the spindle 5, and a diffuser Df2 having a total number of three (J=3) stationary vanes $\mathbf{14}_j$ (j=1~3) and provided with a boss 15 for bearing the spindle 5. The rotary vanes $\mathbf{13}_i$ have a vane inlet angle $\beta_1$ set to 14°, and a vane outlet angle $\beta_2$ set to 10°.

It will be understood that the total number of stationary vanes of diffuser can be reduced to four (J=5) or three (J=3), even in the case of an impeller having a total number of three (I=3) or four (I=4) rotary vanes.

It may however be preferable from the view point of vibration that, for arbitrary integers n and m (n>0, m>0), n I≠J and I≠m J. In other words, the combination (I, J) of I and J may preferably be one of (2, 3), (2, 5), (3, 4), (3, 5), (4, 3), and (4, 5).

By setting the number of rotary vanes 13 within a range of two to four, different from the conventional arrangement in which axial flow vanes are added to a greater number of centrifugal vanes or in which mixed flow vanes are added to centrifugal vanes, it is possible to provide a set of rotary vanes 13 with a smooth angular variation from the vane inlet angle $\beta_1$(14°) at their upstream screw parts 13*a* to a vane outlet angle $\beta_2$(10°~11.8°) at their downstream screw parts 13*c*, in addition to a high passable particle diameter being secured as a proportion of 26% of the channel width at the vane outlet to the outer circumference diameter at the vane inlet, despite the provision of downstream screw parts 13*c* of a centrifugal type in the impeller, without suddenly diameter-expanded parts or suddenly curved parts on the way, thus solving problems of blocking such as in the conventional arrangement in which an inducer simply is added to a centrifugal vane.

According to the configuration above, the rotary vanes $\mathbf{13}_i$ (I=2~4) are wound on the hub 12 at even intervals, and in an axis-symmetrically balanced arrangement to provide the fluid with energy, thus achieving an increased volumetric efficiency and balanced rotation. As a criterion to express the quality of suction performance with respect to the cavitation of pump, "suction-end specific speed" is used. It is difficult to raise this value over 2000 in conventional centrifugal impellers. According to the embodiment, by employment of rotary vanes 13 having their upstream screw parts 13*a* integrally provided therewith, it is possible for the impeller 2 to have a specific speed of 3000 $\text{min}^{-1}\cdot(\text{m}^3/\text{min})^{1/2}\cdot\text{m}^{-3/4}$. This good suction performance enables high-speed rotation without cavitation.

As the inlet angle $\beta_1$ of each vane is set to 14° irrespective of the number of rotary vanes 13 (I=2~4), the anti-cavitation nature is not influenced by the number of vanes.

According to the first embodiment, in the diffuser Df, the guide vanes 14 to be five in number are disposed inside the delivery casing 10, which is reduced in diameter as it extends from the upstream end to the downstream end, and the guide vanes 14 are integrally fixed to the delivery casing 10 and to the vane collecting boss 15, which also is reduced in diameter as it extends downstream, whereby the stationary channels CBj that return toward the axis of the spindle 5 are defined, and the spindle 5 is borne at the distal end by the boss 15. The diffuser Df rectifies swirling streams of fluid pressurized by rotation of the impeller 2, into straight streams, reducing vibration as well as noise.

In the first embodiment, the number of rotary vanes 13 of impeller 2 is set to two, the number of stationary vanes 14 of diffuser Df is set to five, and each rotary vane 13 is made up by an upstream inducer-integrated axial-flow screw part 13*a*, an intermediate mixed-flow screw part 13*b*, and a downstream centrifugal screw part 13*c*, whereby the suction performance is improved so that the suction-end specific speed can be raised to 3000 $\text{min}^{-1}\cdot(\text{m}^3/\text{min})^{1/2}\cdot\text{m}^{-3/4}$. Therefore, even when the rotational speed of the impeller 2 is made fast, no cavitation occurs, and swirling streams pressurized commensurate to the increase in speed are rectified by the diffuser Df, allowing high-head, large delivery operation.

Figure 9:
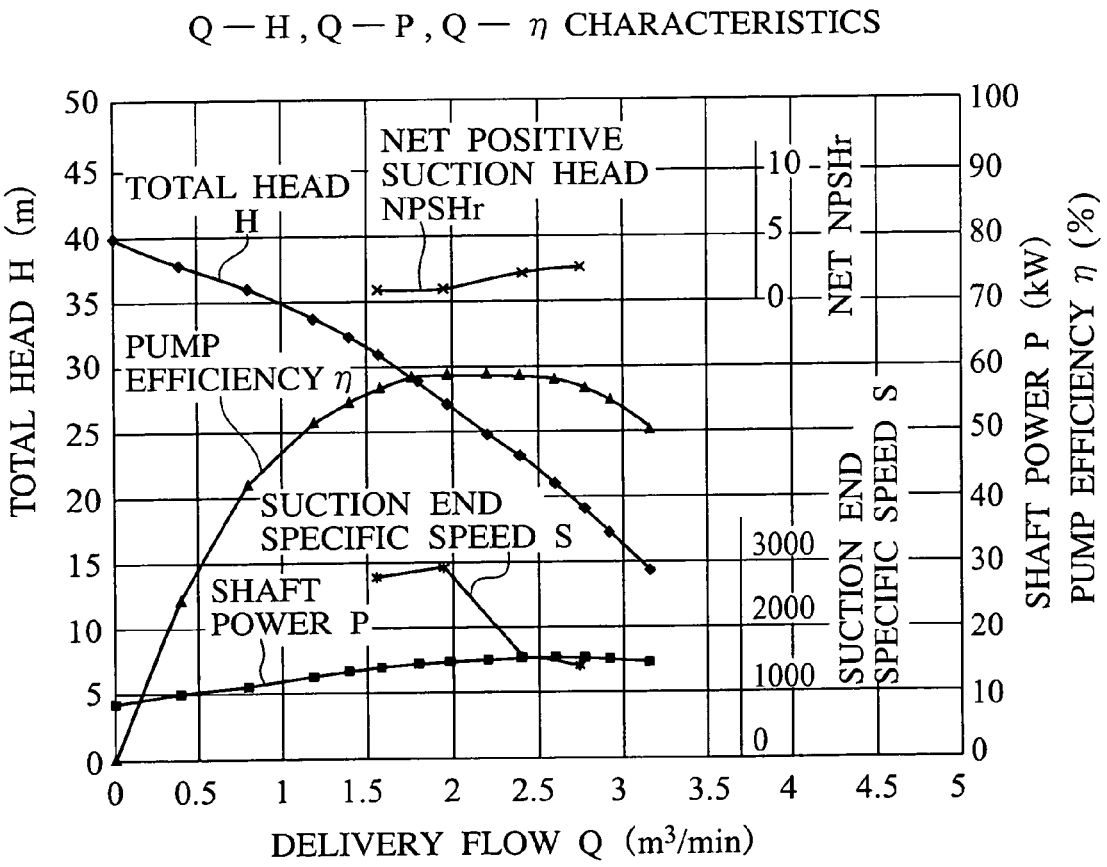
FIG. 9 is a graph showing performance curves of the pump according to the first embodiment.
Figure 10:
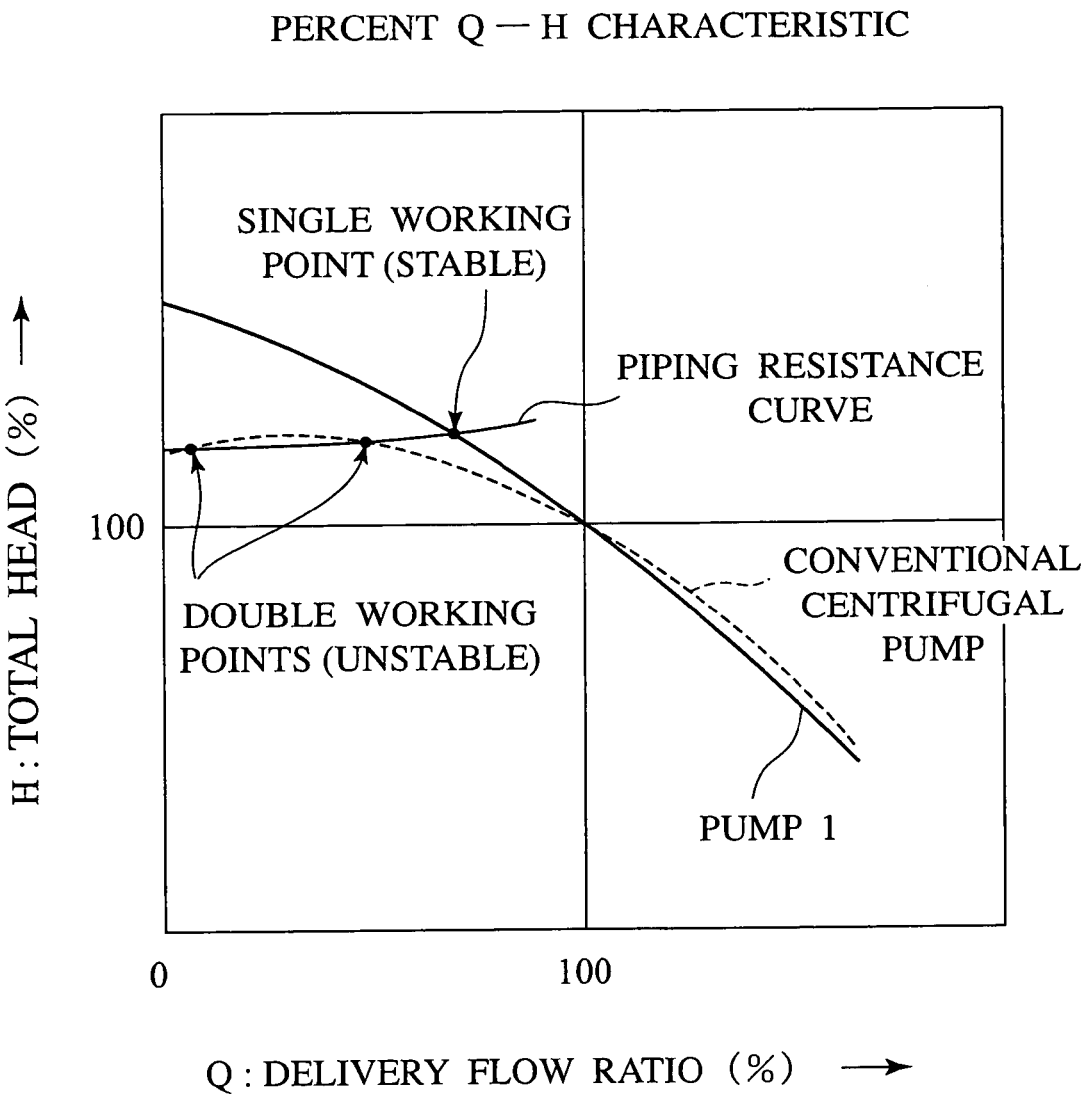
FIG. 10 is a graph showing a percent Q-H characteristic of the pump according to the first embodiment, in comparison with a conventional centrifugal pump.
Figure 11:
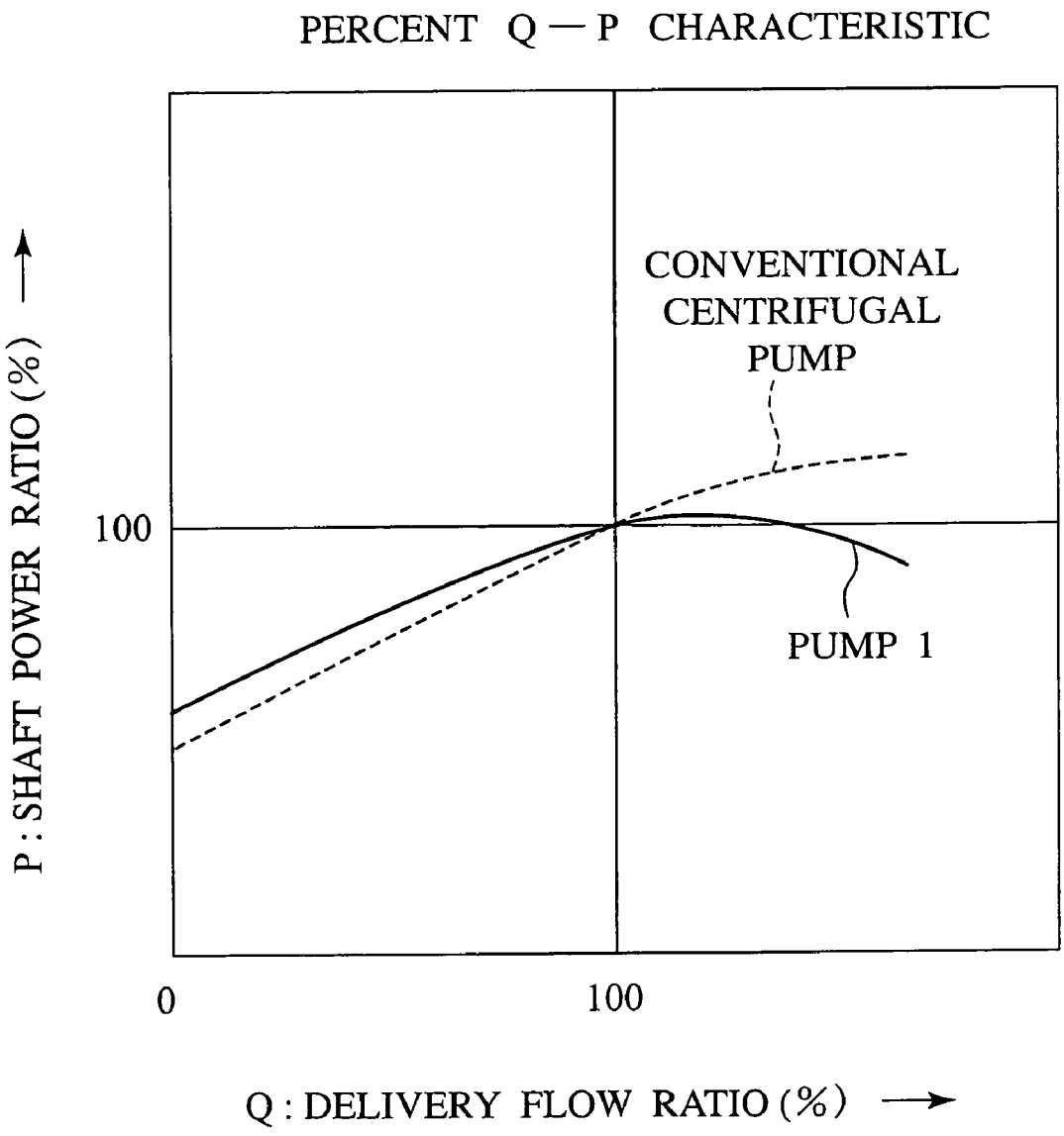
FIG. 11 is a graph showing a percent shaft power characteristic of the pump according to the first embodiment, in comparison with a conventional centrifugal pump.

Characteristic tests of the horizontal shaft turbopump 1 according to the first embodiment were performed, with results shown in FIG. 9~FIG. 11.

FIG. 9 is a graph that shows principal performances of the pump 1, i.e., Q (delivery flow)—H (total head), Q(delivery flow)—P (shaft power), and Q (delivery flow)—η(efficiency) characteristics, concurrently showing Q (delivery flow)—S (suction-end specific speed) and Q (delivery flow)—NPSHr (net positive suction head), where denoted by H is a total head (m), η is a pump efficiency (%), P is a shaft (horse) power (kW), NPSHr is a net positive suction head (m), and S is a suction-end specific speed ($\text{min}^{-1}\cdot(\text{m}^3/\text{min})^{1/2}\cdot\text{m}^{-3/4}$).

As shown in FIG. 9, the total head H linearly decreased, as the delivery flow Q was increased. Variation in the flow Q was small relative to variation in the head H.

The conventional centrifugal pump had a suction-end specific speed of about 1400 $\text{min}^{-1}\cdot(\text{m}^3/\text{min})^{1/2}\cdot\text{m}^{-3/4}$, and it was difficult to improve this value up to 2000 or more. However, in the pump 1 in which the impeller 2 was comprised of an inducer-integrated axial flow portion, a mixed flow portion, and a centrifugal portion, the suction-end specific speed could be raised to 3000 $\text{min}^{-1}\cdot(\text{m}^3/\text{min})^{1/2}\cdot\text{m}^{-3/4}$, with an improved suction performance, as will be seen.

The shaft power P decreased to the right (Q+) of a maximal point of pump efficiency η, where the impeller 2 had a reduced load along the outer periphery, and the axial flow portion as well as the mixed flow portion was effective. In the vicinity of shutoff point, an increase in shaft power P was found due to a reverse-flowing effect at the axial flow portion. However, at the centrifugal portion as the outlet side, no significant great increase in shaft power P was found, unlike the case of conventional axial flow vanes. Therefore, the shaft power P is even so that the handling of the pump is easy.

FIG. 10 is a graph showing a percent Q-H characteristic of the pump 1 in comparison with the conventional centrifugal pump. The abscissa and the ordinate represent a delivery flow Q ($\text{m}^3$/min) and a total head H (m), respectively, in terms of a percent (%) with respect to a value at a maximal point of pump efficiency η.

As shown by broken lines, the conventional centrifugal pump had, in an upper left-hand region where the delivery flow Q is small (Q<100%) and the head H is high (H>100%), a rightward-ascending characteristic intersecting a piping resistance curve at two points, both of which constitute working points of the plant, which may cause unstable operation.

As for the pump 1 shown by solid lines, as the delivery rate Q was increased, the total head H monotonously decreased, without ascending rightward, thus intersecting the piping resistance curve at a single point, thus allowing stable operation, and facilitating pump handling. In this regard, the application should be advantageous to such as a sewage pump that may undergo large variations in suction and/or delivery water level(s).

FIG. 11 is a graph showing a percent Q-P characteristic of the pump 1 in comparison with the conventional centrifugal pump. The abscissa and the ordinate represent the delivery flow Q ($\text{m}^3$/min) and a shaft power P (kW), respectively, in terms of a percentage (%) with respect to a value at the maximal point of pump efficiency η.

The conventional centrifugal pump shown by broken lines had a monotonous increase in shaft power P with the increase in the flow Q, so that the possible range of operation is extremely limited.

As for the pump 1 shown by solid lines, the shaft power P had, in a right region where the delivery flow Q is large (Q>100%), a substantially flat characteristic with a moderate maximal point, which should allow a relatively wide operation range to be secured.

(Second Embodiment)

Figure 24:
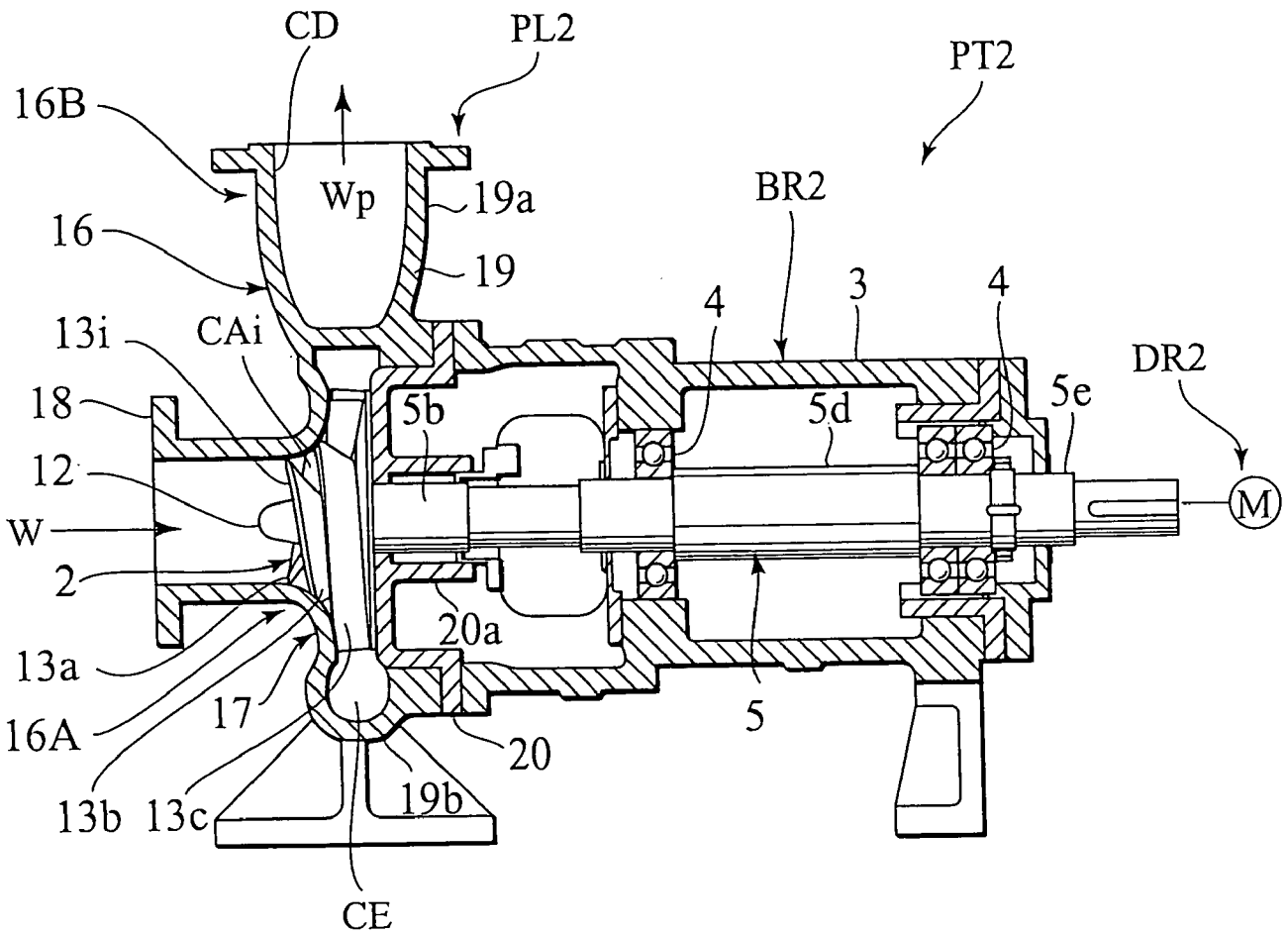
FIG. 24 is a longitudinal sectional view of an essential portion of a plant equipped with a turbopump according to a second embodiment of the invention.

FIG. 24 shows an essential portion PT2 of a plant equipped with a single-staged horizontal shaft type turbopump 16 (hereafter called "horizontal shat pump") according to the second embodiment.

The essential portion PT2 of the plant is configured as a water pumping installation for pumping rain water W pooled at a mediate-to-high-depth underground, and includes a water pumping line PL2 substantially L-shaped in side view, a bearing mechanism BR2 provided to the water pumping line PL2 for bearing a spindle 5 of the horizontal shat pump 16 to be horizontal, and a drive mechanism DR2 for driving the spindle 5 to rotate. The bearing mechanism BR2 is configured with a bearing box 3 having left and right bearings 4 and 4 supporting the spindle 5, at a right half 5*d* thereof in the figure, in a both-end supporting manner. The drive mechanism DR2 includes an externally controlled electric motor 7, and a coupling for fastening a right end 5*e* of the spindle 5 to the motor 7.

The water pumping line PL2 is configured with the horizontal shaft pump 16 that has an integrated pump casing 17 of a stationary type, a water conducting straight pipe (not shown, analogous in configuration to the straight pipe Sp of FIG. 1) flange-connected to a suction casing part 18 of the pump casing 17, and a water sending vertical pipe (not shown) flange-connected to a delivery casing part 19 of the pump casing 17.

The horizontal shaft pump 16 has a single suction type water pumping portion 16A configured, like the first embodiment, to give a head to suctioned water W to be changed to pumped liquid Wp, and a water delivery portion 16B configured for circumferentially guiding pumped liquid Wp to be delivered. The water pumping portion 16A is configured with the suction casing part 18, and a two-vane impeller 2 rotatably inscribed therein, with spiral rotary channels $CA_i$ (i=1, 2) defined therebetween. The water delivery portion 16B is configured with the delivery casing part 19, and a seal plate 20 for sealing a front side of the delivery casing part 19. The delivery casing part 19 is configured, at an upper half 19*a* thereof in the figure, to define a pumped liquid delivery port CD, and at a lower half 19*b* thereof, for cooperating with the seal plate 20 to define a volute-form stationary channel CE that connects the rotary channels $CA_i$ with the pumped liquid delivery port CD. The seal plate 20 has a water-sealing part 20*a* for the spindle 5 to be horizontally provided therethrough at a front part 5*a* thereof.

Like the first embodiment, the impeller 2 has two rotary vanes $\mathbf{13}_i$ (i=1, 2), each rotary vane 13 being configured at an upstream screw part 13*a* thereof for calling water W therein, exerting a force-feeding pressure thereon, at an intermediate screw part 13*b* thereof for pressurizing this water, and at a downstream screw part 13*c* thereof for additionally pressurizing this water to be provided as centrifugally running pumped water Wp with increased speeds. This pumped water Wp is guided by the volute-form stationary channel CE, into the pumped water delivery port CD, wherefrom it is delivered.

The horizontal shaft pump 16, which has the volute-form stationary channel CE, is adapted for a facilitated restoration even after an interrupted pumping due to the occurrence of cavitation or excessive air suction.

(Third Embodiment)

Figure 25:
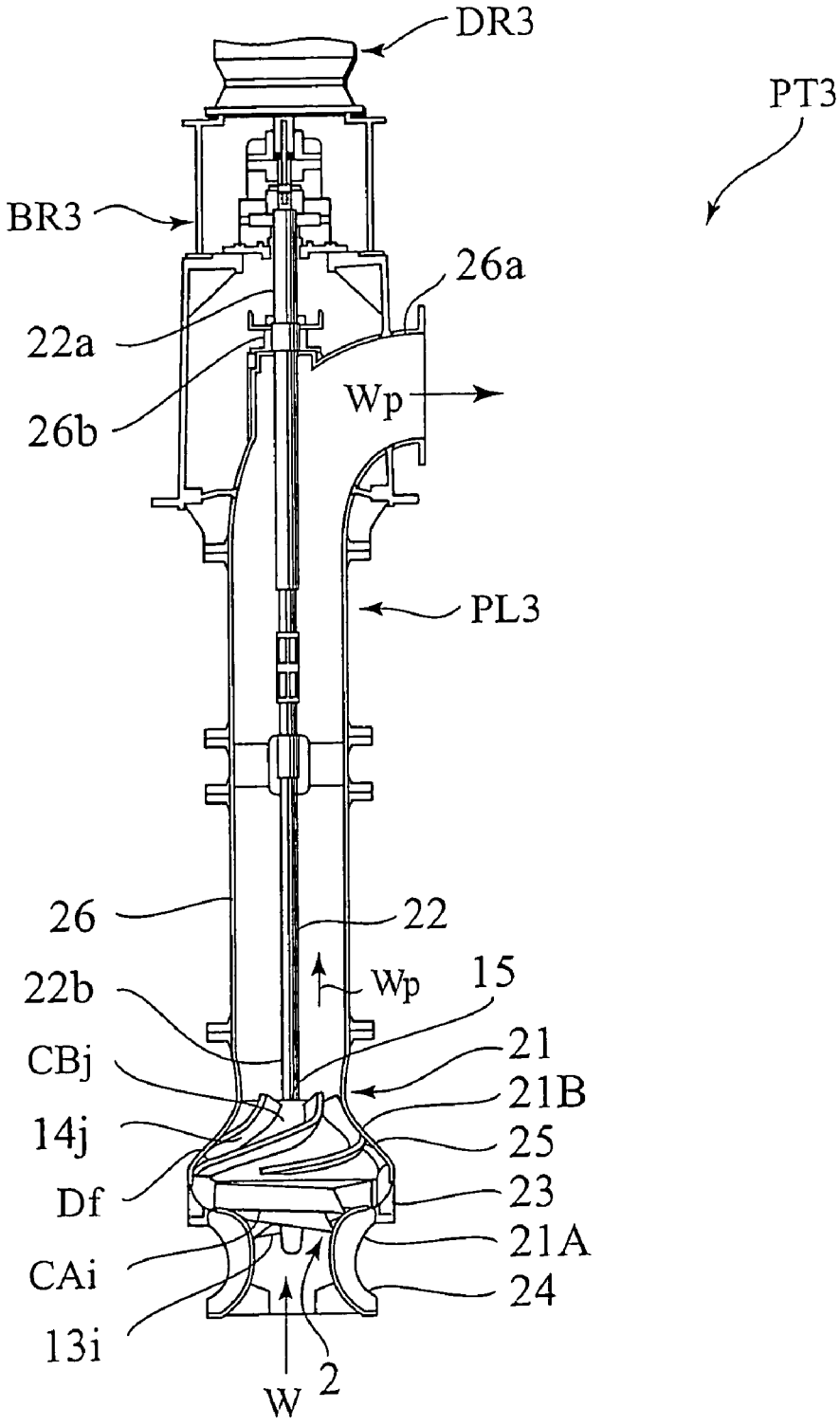
FIG. 25 is a longitudinal sectional view of an essential portion of a plant equipped with a turbopump according to a third embodiment of the invention.
Figure 26:
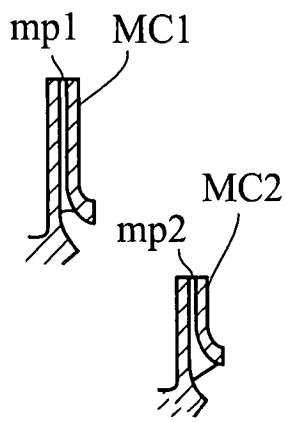
FIG. 26 is a diagram showing a relationship between specific speeds and M-contours of channels of conventional turbopumps.
Figure 26:
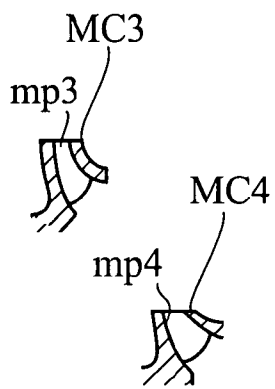
Figure 26:
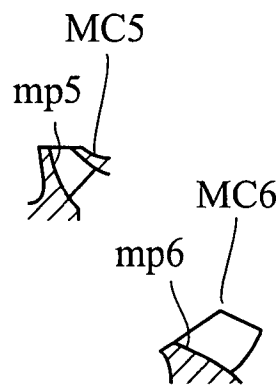
Figure 26:
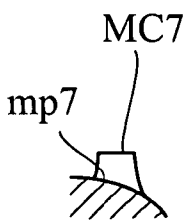

FIG. 25 shows an essential portion PT3 of a plant equipped with a single-staged vertical shaft type turbopump 21 (hereafter called "vertical shat pump") according to the third embodiment.

The essential portion PT3 of the plant is configured as a water pumping installation for pumping rain water W pooled at a high-depth underground or in a well type water tank, and includes a water pumping line PL3 substantially I-shaped in side view, a bearing mechanism BR3 for vertically bearing an upper part 22*a* of a spindle 22 of the vertical shat pump 21 provided in the water pumping line PL3, and an externally controlled drive mechanism DR3 for driving the spindle 5 to rotate.

The water pumping line PL3 is configured with the vertical shaft pump 21 having a pump casing 23 fixed to a support frame, and a water sending vertical pipe 26 flange-connected to a delivery casing part 25 of the pump casing 23. The vertical pipe 26 includes an elbow 26*a*, which has a water sealing part 26*a* for the upper part 22*a* of the spindle 22 extending therethrough.

The vertical shaft pump 21 has a single suction type water pumping portion 21A configured to give a head to suctioned water W to be changed to pumped liquid Wp, and a water delivery portion 21B configured for guiding pumped liquid Wp to be delivered. The water pumping portion 21A is configured with the suction casing part 24, and an impeller 2 provided with a pair of rotary vanes $\mathbf{13}_i$ (i=1, 2) rotatably inscribed therein, with spiral rotary channels $CA_i$ (i=1, 2) defined therebetween. The water delivery portion 21B is configured, as a diffuser Df for returning pumped liquid Wp toward the spindle to thereby deliver it upward, with the delivery casing part 25, five stationary vanes $\mathbf{14}_j$ (j=1~5) integrally formed with the delivery casing part 25, and a boss 15 fixed to these rotary vanes 14 for bearing a lower part 22*b* of the spindle 22, whereby five stationary channels $CB_j$ (j=1~5) are defined.

Suctioned water W from the suction casing 24 is pressurized and speed-increased by the impeller 2, so as to constitute swirling streams, which are rectified by the diffuser Df into straight streams to be delivered to the vertical pipe 26, and discharged from the delivery elbow 24.

According to the embodiments of the invention described, there is provided a pump (1; 16; 21) configured with an impeller (2, 102, 202) arranged in a pump casing (8; 17; 23), so that water (W) suctioned from a suction casing (9; 18; 24) is pressurized by the impeller (2, 102, 202) in the pump casing (8; 7; 23) and discharged from a delivery casing (10; 19; 25), wherein the pump casing (8; 17; 23) is diverged from a starting end to a rear end thereof, and the pump casing (8; 17; 23) has disposed therein a series of rotary vanes (13) each respectively comprised of an upstream screw part (13*a*) projecting along a spindle (5; 5; 22), a sloped intermediate screw part (13*b*), and a steep downstream screw part (13*c*), such that a centrifugal impeller has screw vanes and mixed flow vanes added thereto to render variations in vane angel of the impeller smooth enough to make the pump flat in respect of horsepower and facile of handling, allowing a high head to be achieved, with a secured suction performance.

The impeller (2, 102, 202) is configured with the rotary vanes (13), which are fixed at their intermediate screw parts (13*b*) to a moderately sloping front-stage part (12*a*) of the hub and at their downstream screw parts (13*c*) to a steeply sloping rear-stage part (12*c*) of the hub, so as to prevent the increase in shaft power (P) from getting large at centrifugal vane parts on the outlet side. The rotary vanes (13), which are disposed in the pump casing (8), have their outer peripheries close to an inner periphery of the pump casing (8), and the upstream screw parts (13*a*) thereof have their distal ends (13*a*1) projected into a suction fluid path of the suction casing (9), having a wide suction port defined inside the distal ends (13*a*1), thus improving the suction performance.

The rotary vanes (13) of impeller (2, 102, 202) have a vane outlet channel width ($b_2$) set to 26% in proportion to a vane inlet outer circumference diameter ($d_{io}$), thereby securing a high passable particle diameter to provide the pump with an excellent foreign matter passability.

The rotary vanes (13) wound on the hub (12), i.e. integrally wound therearound, have a vane inlet angle set to 14° to render the suction port diameter of the upstream screw parts (13*a*) large, making the call-in of fluid to the rotary channels (CA) strong, improving the suction performance.

The rotary vanes (13) have a vane outlet angle set with a range of 10°~11.8°, allowing the rotary channels (13) to have a smooth-varying curvature from the upstream screw parts (13*a*) to the downstream screw parts (13*c*).

The number (I) of rotary vanes (13) wound on the hub (12) is limited to 2~4, securing the symmetry of rotary vanes (13) about the spindle (5), thereby improving the rotational balance of fluid and the volumetric efficiency of energy to be imparted.

The diffuser (Df, Df1, Df2), which includes the delivery casing (10; 25) connected to the suction casing (9; 24) and converged at an inner periphery thereof as it extends from upstream to downstream, has stationary vanes (14) provided between the delivery casing (10; 25) and a pear-shaped vane-connecting boss (15), defining return channels (CB) toward the spindle, for delivering water along the axis of rotation, suppressing the occurrence of radial loads as would have been in a vortex chamber, thus reducing vibration.

The above-noted impeller (2, 102, 202) may preferably be applied to a turbopump (16) having a volute-form delivery casing (19) connected to a diverged rear end of a suction casing (18).

The above-noted impeller (2, 102, 202) is applicable to both horizontal shaft pump (1; 16) and vertical shaft pump (21).

According to the embodiments, an impeller (2, 102, 202) provided with 2~4 rotary vanes (13) is configured to be greater, than a conventional centrifugal pump, by 5.4%~12% in vane inlet center diameter ($d_{1m}$), and by 2~2.5 times in vane outlet channel width ($b_2$), allowing collision-less rotary channels (CA) to be defined from upstream screw parts (13*a*) having a vane inlet angle of 14° to downstream screw parts (13*c*) having a vane outlet angle within a range of 10°~11.8°. By setting the number of rotary vanes (13) to three or four, it is possible to make the energy transmission to fluid efficient, allowing the inlet end outside diameter to be reduced, and the outlet end angle to be enlarged. Despite a centrifugal type at the downstream screw parts (13*c*), it is possible to secure an as great passable particle diameter as 26% in proportion of vane outlet channel width (b2) to vane inlet outer circumference diameter ($d_{1o}$), allowing respective channels (CA) to be smoothly changed, without having sudden diameter expansions nor steep curves on the way.

This impeller (2, 102, 202), which is configured at the inlet side as an axial flow type, but at the outlet side as a centrifugal type, does not need great shaft power (P) unlike a conventional axial flow impeller, allowing for the pump to be achieved with an even shaft power characteristic facilitating the handling.

The upstream screw parts (13*a*) of the rotary vanes (13), of which the vane inlet angle is set to 14°, have their inducer parts (13*a*1) continuously formed at the distal ends, with a commensurate improvement in suction performance, in addition to possible elimination of a blocking of foreign matter as would have occurred in a conventional system having a separate inducer added to centrifugal vanes.

According to the embodiments, 2~4 rotary vanes (13) are wound about a hub (12) at equal intervals, so as to be arranged axis-symmetrical at respective corresponding locations on the spindle (5, 22), thus allowing balanced rotations, and an improved volumetric efficiency of energy transmission to the fluid.

If the pump (1, 16, 21) is large-scaled so that the water pumping line (PL1, PL2, PL3) has a large connection diameter, the number (I) of rotary vanes (13) may well be set to three or four, in order for the respective vanes (13) to be continuous from the inlet to the outlet, allowing an improved suction performance, securing a sufficient passable particle diameter. Although it was difficult for conventional centrifugal pumps to have a suction-end specific speed raised over 2000, the embodiments having upstream screw parts (13*a*) as described are adapted for a suction-end specific speed of 3000 $min^{-1}\cdot(m^3/min)^{1/2}m^{-3/4}$, allowing a good suction performance even at high-speed rotation, with possible prevention of the occurrence of cavitation.

The upstream screw parts (13*a*) have an inducer function, which increases the propulsive force, with a commensurate increase in the quality of suction performance, as well as in the forcing pressure to the intermediate screw parts (13*b*). Accordingly, the intermediate screw parts (13*b*) hardly have local pressure reduction occurring therebetween, so that vibration as well as noise due to cavitation can be prevented.

At the intermediate screw parts (13*b*) constituting a mixed flow type, the fluid is pressurized by pumping forces of rotary vanes (13) and by centrifugal forces acting on flux of fluid diagonally running along channels (CAb), and the pressurized fluid is additionally pressurized and speed-increased by centrifugal effects of the downstream screw parts (13*c*). This pressurized and speed-increased fluid, i.e., pump liquid Wp is: rectified into straight streams by return channels (CB) of the delivery casing (10, 25) in the first or third embodiment, so that it is delivered with reduced vibration and reduced noise even at a relatively high head; or delivered via the delivery casing (19) in the second embodiment, at a high head.

In other words, an enhanced suction performance allows for a required head to be kept even if the flow rate is increased, enabling operation at high speed.

As will be seen from the foregoing description, according to the preferred embodiments of the present invention, in a turbopump (1; 16; 21) configured with an impeller (2, 102, 202) arranged in a pump casing (8; 17; 23) so that water (W) suctioned from a suction casing (9; 18; 24) is pressurized by the impeller (2, 102, 202) and discharged from a delivery casing (10; 19; 25), a rear part (9*b*) of the suction casing (9; 18; 24) is diverged from a starting end to a rear end thereof, to dispose there a series of rotary vanes (13) each respectively comprised of an upstream screw part (13*a*) projecting along a spindle (5; 5; 20), a sloped intermediate screw part (13*b*), and a steep downstream screw part (13*c*).

The rotary vanes (13) are wound at their intermediate screw parts (13*b*) on a sloping front stage part (12*a*) of a hub (12), and at their downstream screw parts (13*c*) on a steeply sloped rear stage part (12*b*) of the hub (12).

The rotary vanes (13) are configured at their outer peripheries to come close to an inner periphery of the suction casing rear part (9*b*), and their upstream screw parts (13*a*) to have distal ends (12*a*1) thereof projected into suction channels of the suction casing (9; 18; 24).

The impeller (2, 102, 202) has a vane outlet width ($b_2$) thereof set to 26% in proportion to an inlet outer circumference diameter ($d_{1o}$).

The rotary vanes (13) wound on the hub (12) have a vane inlet angle ($\beta_1$) set to 14°.

The rotary vanes (13) wound on the hub (12) have a vane outlet angle ($\beta_2$) set within a range of 10°~11.8°.

The number of rotary vanes (13) wound on the hub (12) is limited to 2~4.

The delivery casing (10; 25) connected to the suction casing rear part (9*b*) is converged as it extends from a starting end to a rear end thereof, and a vane-collecting boss (15) provided with stationary vanes (14) is disposed in the delivery casing (10; 25), defining return channels (CB) toward the axis.

The delivery casing (19) connected to the rear part of the suction casing (18) has a volute casing part (19*b*).

The turbopump is configured as a horizontal shaft pump (1; 16).

The turbopump is configured as a vertical shaft pump (21).

INDUSTRIAL APPLICABILITY

According to the present invention, the turbopump can be improved in suction performance and passing performance, allowing the draining of rain water, pumping of water at deep underground, transfer of sewage or general industrial waste water, or the like to be facilitated.

The invention claimed is:

1. A turbopump in which a single impeller of an open-vane form having a total number of I (I>1) rotary vanes is disposed in a single pump casing, wherein each rotary vane comprises:

an axial flow vane part having an inducer part continuously formed thereon, the axial flow vane part being configured to generate an axial flow;

a mixed flow vane part collisionlessly connected to the axial flow vane part; and a centrifugal vane part collisionlessly connected to the mixed flow vane part.

2. The turbopump as claimed in claim 1, wherein the inducer part confronts a straight-tubular part of a suction casing of the pump casing.

3. The turbopump as claimed in claim 1, wherein I=2~4.

4. The turbopump as claimed in claim 1, wherein each rotary vane has a vane inlet angle of 14°.

5. The turbopump as claimed in claim 1, wherein each rotary vane has a vane outlet angle within a range of 10°~11.8°.

6. The turbopump as claimed in claim 1, comprising a total number of I rotary channels defined by the total number of I rotary vanes, each rotary channel having a vane outlet channel width thereof set to 26% of a vane inlet outer circumference diameter of the total number of I rotary vanes.

7. The turbopump as claimed in claim 1, further comprising a diffuser having a total number of J (J<6) stationary vanes disposed downstream of the impeller.

8. The turbopump as claimed in claim 1, wherein the pump casing comprises a suction casing part configured to accommodate the impeller, and a volute-form delivery casing part connected to the suction casing part.

9. The turbopump as claimed in claim 1, wherein the impeller has a horizontal spindle.

10. The turbopump as claimed in claim 1, wherein the impeller has a vertical spindle.

11. A turbopump in which a single impeller having a total number of I (I>1) rotary vanes is disposed in a single pump casing, wherein each rotary vane comprises:

an axial flow vane part having an inducer part continuously formed thereon;

a mixed flow vane part collisionlessly connected to the axial flow vane part; and a centrifugal vane part collisionlessly connected to the mixed flow vane part, wherein the inducer part confronts a straight-tubular part of a suction casing of the pump casing.

12. A turbopump in which a single impeller having a total number of I (I>1) rotary vanes is disposed in a single pump casing, wherein each rotary vane comprises:

an axial flow vane part having an inducer part continuously formed thereon;

a mixed flow vane part collisionlessly connected to the axial flow vane part; and a centrifugal vane part collisionlessly connected to the mixed flow vane part, wherein I=2~4.

13. A turbopump in which a single impeller having a total number of I (I>1) rotary vanes is disposed in a single pump casing, wherein each rotary vane comprises:

an axial flow vane part having an inducer part continuously formed thereon;

a mixed flow vane part collisionlessly connected to the axial flow vane part; and a centrifugal vane part collisionlessly connected to the mixed flow vane part, wherein each rotary vane has a vane inlet angle of 14°.

14. A turbopump in which a single impeller having a total number of I (I>1) rotary vanes is disposed in a single pump casing, wherein each rotary vane comprises:

an axial flow vane part having an inducer part continuously formed thereon;

a mixed flow vane part collisionlessly connected to the axial flow vane part; and a centrifugal vane part collisionlessly connected to the mixed flow vane part, wherein each rotary vane has a vane outlet angle within a range of 10°~11.8°.

15. A turbopump in which a single impeller having a total number of I (I>1) rotary vanes is disposed in a single pump casing, wherein each rotary vane comprises:

an axial flow vane part having an inducer part continuously formed thereon;

a mixed flow vane part collisionlessly connected to the axial flow vane part; and a centrifugal vane part collisionlessly connected to the mixed flow vane part, wherein the turbopump comprises a total number of I rotary channels defined by the total number of I rotary vanes, each rotary channel having a vane outlet channel width thereof set to 26% of a vane inlet outer circumference diameter of the total number of I rotary vanes.

* * * * *